US009890612B2

(12) United States Patent
Diez et al.

(10) Patent No.: US 9,890,612 B2
(45) Date of Patent: Feb. 13, 2018

(54) SELF-CONTAINED PORTABLE UNIT FOR STEAM GENERATION AND INJECTION BY MEANS OF INJECTOR WELLHEAD HANGER OF COILED JACKETED CAPILLARY TUBING WITH CLOSED CIRCUIT AND PROCEDURE FOR ITS OPERATIONS IN OIL WELLS

(71) Applicant: OIL ADDPER SERVICES S.R.L., Neuquen (AR)

(72) Inventors: Martin Diez, Neuquen (AR); Marcelo Viaggio, Neuquen (AR)

(73) Assignee: OIL ADDPER SERVICES S.R.L., Neuquen (AR)

( * ) Notice: Subject to any disclaimer, the term of this patent is extended or adjusted under 35 U.S.C. 154(b) by 397 days.

(21) Appl. No.: 14/489,042

(22) Filed: Sep. 17, 2014

(65) Prior Publication Data

US 2016/0076347 A1 Mar. 17, 2016

(30) Foreign Application Priority Data

Sep. 17, 2013 (MX) ..... MX/A/2013/010604

(51) Int. Cl.

| | |
|---|---|
| ***E21B 36/02*** | (2006.01) |
| ***E21B 43/24*** | (2006.01) |
| ***E21B 33/04*** | (2006.01) |
| ***E21B 33/128*** | (2006.01) |
| ***E21B 36/00*** | (2006.01) |
| ***E21B 17/02*** | (2006.01) |

(52) U.S. Cl.

CPC ..... *E21B 36/025* (2013.01); *E21B 33/04* (2013.01); *E21B 33/1285* (2013.01); *E21B 36/006* (2013.01); *E21B 43/2401* (2013.01); *E21B 17/02* (2013.01)

(58) Field of Classification Search

CPC ..... E21B 36/025; E21B 36/006

See application file for complete search history.

(56) References Cited

U.S. PATENT DOCUMENTS

2005/0061512 A1* 3/2005 Reid ..... E21B 33/037 166/335

2010/0206576 A1* 8/2010 Donald ..... E21B 33/03 166/368

OTHER PUBLICATIONS

Definition of "tubing hanger" incluiding image. Accessed on Sep. 27, 2016 via http://www.glossary.oilfield.slb.com/.*

(Continued)

*Primary Examiner* — Giovanna C Wright
*Assistant Examiner* — Manuel C Portocarrero
(74) *Attorney, Agent, or Firm* — Michael D. Eisenberg

(57) ABSTRACT

A self-contained portable unit for steam generation and injection by means of an injector wellhead hanger of coiled jacketed capillary tubing with a closed circuit and procedure for operation in oil wells comprises a portable, self-contained equipment for injection and dewaxing of heated fluids mounted on a hauler that includes a heat exchanger, a water tank, a heat exchanger, a softener, a centrifugal pum, a lubricant tank, a power engine, an electrical power generator, a control cabin, a fluids softener, a steam boiler, a reservoir tank, a fuel tank, a hose reel and one hose set for two lines of fluid injection and return of that connect to a wellhead hanger/injector for two capillaries making up a closed circuit. This wellhead includes three module and crowned with a lid, two of which are hangers and the rest are injection-type.

7 Claims, 16 Drawing Sheets

(56) References Cited

OTHER PUBLICATIONS

Definition of casing hanger. Accessed on Sep. 27, 2016 via http://www.glossary.oilfield.slb.com/.*

* cited by examiner

STEAM CIRCULATION IN
INJECTION TIP

SELF-CONTAINED PORTABLE UNIT FOR STEAM GENERATION AND INJECTION BY MEANS OF INJECTOR WELLHEAD HANGER OF COILED JACKETED CAPILLARY TUBING WITH CLOSED CIRCUIT AND PROCEDURE FOR ITS OPERATIONS IN OIL WELLS

CROSS-REFERENCES TO RELATED APPLICATIONS

This application claims priority under 35 U.S.C. 119(b) from Mexican Application Serial Number MX/a/2013/010604 filed Sep. 17, 2013, which is hereby incorporated herein by reference in its entirety.

TECHNICAL FIELD

This invention relates to a self-contained portable unit for steam generation and injection by means of injector wellhead hanger of coiled jacketed capillary tubing with closed circuit and a procedure for its operation in oil wells.

BACKGROUND OF THE INVENTION

In the oil industry, steam is used in various processes for both Downstream and Upstream, which results in the need to generate designs for each process for each specific case from those studies. The different designs involve constant innovation and creation of new techniques to improve its processes, work environment quality and environment-friendliness. In the processes in which steam is used, the latter is necessary to modify the state of some heavy and extra-heavy oil, and it is then when our development applies, with the best expected results under specific analysis procedures for each well to be worked on, resulting in the application. The developed technique consists in three main steps: generating heat energy in the needed surface, pressurizing it for different operational needs and conducting that energy to the preset depth of the well(s) to be worked on, thus making, by that displacement and residence time throughout the capillary tubing, the heat transference needed to incorporate controlled temperature to the oil, which is immobilized in the depth. It returns to the surface through another concentric capillary tubing, "at no time being the steam/condensate in contact with the oil", thus generating a closed "Depth-Surface" circuit, and minimizing the consumption of water for steam generation as well as polluting gases produced in the surface by the generator equipment. This innovation provides an alternative technology that introduces significant improvements for oil and gas production. These new technologies are applied to services, heavy and extra-heavy oil well stimulation, clean-up of flow line (FL) in wells that are in production, heavy and extra-heavy crude oil wells, python clean-up and washing, tanks, pulling assistance and in trapped tubing. This invention is based on a system for generating, pressurizing and injecting steam in depth in oil wells though highly versatile equipment that links various elements and incorporates equipment and parts that have a high invention value. In the status of the technique we find, on the one hand, equipment that use various elements, such as a steam generating boiler or a water treatment system, or others that incorporate a power generator, a chemical feeding system, an overfeeding pump and an alternative pump for flow and pressure. The versatility of this equipment allows pumping steam or water simultaneously, being it hot or at room temperature, though different lines and up to 12 wells simultaneously, or in a conduction pipe. The same equipment has a steam jenny and it is used to install partially or permanently where the use of high temperatures is required to improve processes.

The main purpose of this invention consists in providing a "SELF-CONTAINED PORTABLE UNIT FOR STEAM GENERATION AND INJECTION BY MEANS OF INJECTOR WELLHEAD HANGER OF COILED JACKETED CAPILLARY TUBING WITH CLOSED CIRCUIT AND PROCEDURE FOR ITS OPERATION IN OIL WELLS" that provides a compact portable, highly versatile equipment resulting from the fusion of the formerly mentioned equipment with said second equipment in one single equipment, consisting of a compact automated module that generates steam, heats water, heats oil, feeds chemicals and pumps them independently or simultaneously at high pressure and flow, with or without temperature, obtaining excellent results in new operation modalities.

This equipment consists of a steam jenny, a water/oil boiler, a water treatment plant, a power generator, a chemical feeding system, an alternative pump for flow and pressure, a reservoir tank, independent steam and oil/water conduction lines, an operations control cab and a device named hanger with bottom-hole tool. The assembly, except for the hanger, is mounted on a hauler, which makes it fully portable and self-contained equipment that offers a wide range of applications. The "SELF-CONTAINED PORTABLE UNIT FOR STEAM GENERATION AND INJECTION BY MEANS OF INJECTOR WELLHEAD HANGER OF COILED JACKETED CAPILLARY TUBING WITH CLOSED CIRCUIT AND PROCEDURE FOR ITS OPERATION IN OIL WELLS" consists of a compact, portable equipment for generating steam and heating water/oil in any place where necessary, in the field or in facilities such as storage or treatment plants, or simultaneous, in conduction or process pipes, in in situ termination or workover of oil and gas wells. The peculiarity of this equipment is precisely that it takes different components that until today only worked separately and assembles them in one single portable platform, which solves the different stages, having equipment that helps to perform all phases of this activity by the well.

This invention provides a wide range of applications:

- Pumping fluid with temperature and flow;
- Releasing pinched drilling strings;
- Assisting pulling equipment (for saving hours without extracting the tubing;)
- Cleaning tubing;
- Cleaning conduction pipes;
- Testing hermetism;
- Cleaning assemblies (receivers, collectors;)
- Feeding chemicals;
- Injecting fresh water for dissolving or displacing salt or sand in conduction lines;
- Generating, pressurizing, transporting and injecting steam in depth in heavy and extra-heavy oil producing wells.

The "SELF-CONTAINED PORTABLE UNIT FOR STEAM GENERATION AND INJECTION BY MEANS OF INJECTOR WELLHEAD HANGER OF COILED JACKETED CAPILLARY TUBING WITH CLOSED CIRCUIT AND PROCEDURE FOR ITS OPERATION IN OIL WELLS" provides a novelty hanger, a tool designed for oil recovery applications by means of heating fluid, which consists of a capillary hanger of different sizes, allowing for the circulation of heating fluid throughout the strings, entering though a three quarter (¾) tubing and recovering at three eights (⅜). Said hanger is a surface tool made up of three modules: the lower module (hanger) is set to hang and host a capillary tubing with ¾ external diameter; the mid module is used as a heating fluid (steam/water) injector; and the upper module is identical to the lower one but designed to hang a duct or capillary with an external diameter of ⅜. Said hanging parts hold the capillaries inside the tubing (flow line). To prevent the capillaries from moving, the head has a set of double-clip clamps that allow no movement of the capillaries in any direction, and the set of packing elements (gasket) provide for operation at high temperatures and pressure of heating compressed water. The packing strength applied between the capillaries and the hangers is produced by means of a source or hydraulic power; hence it can be regulated, monitored and modified exactly when necessary, even during production procedure. The injector has the purpose of introducing heating fluid in the capillaries. Inside, it has a heavy-duty sacrificial jacket that is able to endure the change of direction of the heating fluid and the possible erosion caused by it to the ¾ capillary that is inside. This invention provides the following advantages: it provides the circulation of heating fluids at high temperatures and pressures while the double clamp provides for packing strength regulation even after the production process is started. The Procedure: Steam Injection with Jacketed Capillary Tubing: It consists of using two capillaries with different diameters, in this case, a ø ¾ inch capillary tubing through which steam is introduced at 150° C. and inside of which another ø ⅜ inch capillary tubing is placed through which the heating fluid is recovered, thus generating a closed circuit with two concentric lines of flexible tubing. For this, both tubes are hanged by means of the hanger/injector that holds and seals them on a blowout preventer, and the remaining set are the bottom-hole tools, which are moved down to the required depth, accessing it inside of the flow pipe (flow line.) The steam injection technology consists of providing the necessary heat energy to the heavy and extra-heavy oil wells, accessing at preset depths by means of the flow line, conduction pipe and storage tank, in case they are in the same site. This invention resorts to the capillary tubing through the FL (flow line) to drive the heat energy that is generated on the surface to the present depth thresholds. In order to introduce the capillary tubing, said hanger and a bottom-hole tool are available, both designed especially for this sole application, consisting of two different equipment: a coiled jacketed capillary tubing hanger (located on the well valve shaft) and the depth tool which has different components (diffuser-type tip jet, centralizers, shut-off valves and weight bars), a set that is associated to the capillary tubing by connectors that secure the link between both devices. Each head has three modules, two hangers (each holding and packing a capillary), and a central body with side entrance named "injection Tee," which provide for connection the steam inlet line. In this way, a system is generated for injecting steam at 150° C., transporting it by means of pressure applied throughout the flexible tubing with bigger diameter and recovering that steam through the smaller flexible tubing with return to the heat power source. This invention provides a novelty solution for recovering hydrocarbons, since it provides heat power inside oil wells with high viscosity for speeding and increasing production by means of a closed steam circulation system with return that is fully isolated from oil production, which requires less power resources to renew the injected steam.

BRIEF SUMMARY OF EMBODIMENTS OF THE INVENTION (1) In a variant, a self-contained portable unit for steam generation and injection via an injector wellhead hanger of coiled jacketed capillary tubing with a closed circuit for operation in oil wells, comprises: a self-contained equipment for injection and dewaxing of heated fluids, comprising one hose set for two lines of fluid injection, the lines being connected to a wellhead hanger/injector for two capillaries making up a closed circuit. The wellhead comprises three modules crowned with a lid, two of which are a first and second hanger and at least one is an injection-type, said hanger module having a set of double clamps that support capillary tubing of greater cross section. The injector overlaps the hanger and is fixed. The injector is connected to the portable unit for steam generation via a hose, and overlapping the injection-type module, an upper hanger is fixed, which has a capillary of smaller cross section and recovers steam from a well, and leading the fluid to the injector where it is treated thermally, and from the end of the capillary of the upper hanger, it is inserted in the tubing, making a closed circuit.

(2) In another variant, a self-contained portable unit for steam generation and injection via an injector wellhead hanger of coiled jacketed capillary tubing with a closed circuit for operation in oil wells, comprises: a portable equipment for injection and dewaxing of heated fluids mounted on a hauler, comprising: a first heat exchanger; a water tank; a second heat exchange; a softener; a centrifugal pump; a lubricant tank; a power engine; an electrical power generator; a control cabin; a fluids softener; a steam boiler; a reservoir tank; a fuel tank; a hose reel; and one hose set for two lines of fluid injection, the lines being connected to a wellhead hanger/injector for two capillaries making up a closed circuit. The wellhead comprises three modules crowned with a lid, two of which are a first and second hanger and at least one is an injection-type, said hanger module having a set of double clamps that support capillary tubing of greater section. The injector overlaps the hanger and is fixed, the injector connected to the portable unit for steam generation via a hose, and overlapping the injection-type module, an upper hanger is fixed, which has a smaller capillary and recovers steam from a well, leading the fluid to the injector where it is treated thermally, and from the end of the capillary of the upper hanger, it is inserted in the tubing and a set of bottom-hole tools with a foot valve, check valve and injection point is fixed by pressure to it, making a closed circuit.

(3) In a further variant of the self-contained portable unit for steam generation and injection by means of an injector wellhead hanger of coiled jacketed capillary tubing with a closed circuit for operation in oil wells, the portable unit is laid on a hauler built with a metallic section on a running gear to which the heat exchanger is fixed transversally on its front end, which is linked by tubing to a juxtaposed tank and, transversally to the hauler. The tank feeds water to the heat exchanger and the softener, and juxtaposed to the tank is a centrifugal pump. Juxtaposed to said tank, transverse to the chassis, the lubricant tank feeds lubricant through a tubing section to the power engine and the electric power generator which are juxtaposed to each other and longitudinally with respect to the chassis. The control cabin and the fluid softener are connected though a tubing section to the steam boiler and are laid out longitudinally, which is connected by a tubing section through which water is fed through from the reservoir tank.

Transversally, the fuel tank is placed to feed liquefied propane gas to the boiler and in the back of the chassis, the hose reel holds hoses for two heated fluid conduction lines, comprising an injection line that leads the steam to the injector of the head, and a recovery line that leads steam or heated fluid from the upper hanger which make up said wellhead hanger/injector.

(4) In still another variant of the self-contained portable unit for steam generation and injection by means of injector wellhead hanger of coiled jacketed capillary tubing with a closed circuit for operation in oil wells, the two hanger modules are configured for different size capillaries and provides a circuit for heated liquid circulation through strings entering, through first tubing and recovering through second capillary tubing smaller than the first tubing. The hanging head is configured to overlap and support the well's head that the first hanger module is fixed to by means of a coupling flange to the upper well head flange. The first hanger module hosts a set of double clamps that supports the capillary with greater section. Overlapping the hanger module is the injection module that is fixed by the respective coupling flanges, which are configured to allow access to the heated fluids line that is connected to said equipment. Overlapping the injection module is the second hanger module that is fixed with the respective coupling flanges that are configured to fit the capillary with smaller diameter, which is fixed and hanged with a double clamp and jacketed by that bigger capillary. At the top of the wellhead is a lid with a steam blowout duct. The first and second hangers have identical morphologies, in contrast to a rubber jacket that is placed in said upper hanger and the first and second hangers both comprise.

Upper and lower threaded parts are configured as external casing. The upper and lower threaded parts are configured to fit with each to form a seal and a cylindrical structure in vertical position with upper and lower connections in the shape of flanges and the upper and lower bodies, which have formed flanges, have a cylindrical configuration and in their corresponding ends there is an annular cantilever that offers a two flanges for coupling. The upper threaded portion comprises a cylindrical cavity with five portions having different diameters.

A first of the five portions is located in an end and provides a circular mouth, followed by a second portion with a reduced diameter, followed by a third portion with the same diameter as the first portion, followed by a fourth portion with the same length as said first portion, and followed by the fifth portion that is configured in the end opposed to flange, finishing with a beveled border, which is connected to the cavity of the lower flange body.

The upper threaded portion is configured to lock by a ninety-degree stop followed by a threaded wall, and the ninety-degree stop offers an annular surface that makes contact with the lower threaded portion and a dap around the wall, hosting a joint, which is followed by a second ninety-degree rounded border, followed by a second ninety-degree stop that finishes in a beveled edged opening that is configured to connect with a cylindrical cavity of the body of the lower threaded portion.

The cavity has five more portions and each portion having different diameters wherein the sixth portion of the lower threaded portion's cavity configures as an opening with an upper perpendicular border configured to connect with the annular surface, followed by a beveled border configured such that when it is locked against the first ninety-degree border, followed by a second annular border where the upper threaded portion rests, followed by the seventh portion with a slightly smaller diameter, followed by an eighth portion that is longer with a slightly smaller diameter, followed by a joint border at ninety degrees, followed by a ninth portion with a slightly of greater diameter finishing in a right-angle edge that terminate in a tenth portion configured with an opening. The opening of the tenth portion is configured to connect a cavity of the wellhead with a master valve which is connected to the blowout duct. First and second hanger modules respectively hold in their cavity a double clamp wherein each double clamp holds the capillaries that hang within tubing, referred to previously as capillary tubing. The first module holds the capillary with greater section and the second module is jacketed by this greater capillary and holds the smaller capillary.

Clamps are driven by means of hydraulic fluid that confers the packing force applied between both capillaries and the corresponding first hanger and such that the pressure can be regulated, monitored and modified at any time. The lower threaded body of each respective hanger modules have two lateral holes that connect to a pressure pump and a first hole receives hydraulic fluid with pressure and is configured to lead the fluid to the clamp that fits the capillary with a gear and is packed by compression of elastomers whereas the second hole, if open, spills the hydraulic fluid deactivating the clamps and the packing and releasing the capillary.

The clamps comprise: three dentate clamps which are radially placed in a clamp holding a tubular jacket such that inner faces of cylindrical concave configuration equipped with a cross-sectional succession of teeth forming friction that moves towards the center of the module by displacement and holds the capillary adjusting to its diameter and fitting the tubing. Any clamp has an interior groove or central valley that creates a double grasp clap by dividing each clamp into an upper and lower portion wherein the upper portion prevents the tubing from slipping upwards and the lower portion prevents the tubing from slipping downwards. Each clamp has a clamp spring located in the central valley which is configured to keep the clamp expanded with their an external face close to the internal wall of the respective hanger module. The clamps are configured to be open and closed by effect of the movement of cones which closes through compressing the spring. Cones include a tubular cylindrical lower clamp cone and a tubular cylindrical upper clamp cone wherein each cone contains a truncated cone shaped internal portion with dimensions configured to exactly match the dimensions of the external face also of truncated cone shaped portion of each respective clamp such that when the clamp is driving by hydraulic pressure, this upper clamp cone moves in downwards coming near to lower clamp cone such that the three dentate clamps are gradually incorporated into this truncated cone shaped cavity moving towards the center of the module reducing the inner diameter and clamping the tubing. The double clamps have two jacket buffers an upper and a lower one that are solidary to the clamp carrying jacket and fix the cones to the jacket, keeping the set together so that they prevent the displacement of the cones when being distanced, maintaining all the pieces together.

The injection module is comprises: a position configured to interpose the first and second hangers; a lateral access duct by which a heating fluid is injected from the boiler; a body of a tubular configuration in whose corresponding opposite ends they have an annular portion, with respect to a cylindrical wall configuring an upper yoke and a lower yoke, that connects to the lower yoke of the second hanger and one lower yoke that connects to the upper yoke of the first hanger; an injection configured to inject the heating fluid between the capillaries; and an interior equipped with a heavy-duty sacrificial jacket that supports the change of direction of heating fluid and the possible erosion that this can cause to the capillary and allows for the circulation of heating fluids at high temperatures and pressures. At the top of the wellhead and the fixed overlapping the second hanger module is a closing lid, which is coupled by a yoke with screws, that has a return hole that leads the steam or heating fluid to a hose connected to the portable unit allowing recovery of said fluid that is coming up from the well, such that a closed circuit is formed and the fluid does not come in contact with the well fluids and pressures.

Double clamps are configured to regulate the packing force even after the production process is started and the packing set is comprised of: a rubber holding jacket configured to hold three rubber screws, two space rings built with a flexible high-temperature compound that is easily compressed and expanded with inner diameters compatible with the internal passing of the hanger where the flexible tubing passes and external diameters of these rings coinciding with the inner diameter of the yoke body, where they overlap and separated from each other by said rings that contain them at the time of compression, and between these rings are an upper retaining ring and a lower bumper; an upper retaining ring over the rubber packing which serves as support and anti-extrusion barrier of the rubber at the time of compression. A lower bumper underneath the rubber packing that supports and backs up the rubbers in compression state is provided. The ring is solidary to the lower body and lacks movement.

The packing set seals and closes off the annular space between the outer diameter of the flexible tubing and the inner diameter of the hanger body, generating a barrier in the annular space of the well where the packing set activates when receiving an axial load with force applied downwards on the upper retaining ring which transmits to the pieces arranged underneath, wherein the axial load generates a compression on rubbers and they react expanding their volume concentrically towards the blowout zone, the center, until making contact and pressure against the flexible tubing located inside of the hanger, obtaining packing on the capillary. This axial load results from the applied hydraulic pressure through the lower hole that is in the lower body, simultaneously driving the clamps and the rubber set. In order to complete the unit, and essential part of this invention, i.e., the steam or heating fluid injection closed circuit in the required depth of the well, it was necessary to solve a serious of problems. This is why a set specially designed well bottom tools was added in the end of the tubing.

(5) In yet a further variant, a self-contained portable unit for steam generation and injection by means of injector wellhead hanger of coiled jacketed capillary tubing with closed circuit and procedure for operation in oil wells, further comprises a set of bottom-hole tools including: a capillary connector; a displacement dart; a dart socket; a foot valve; and an injections point. The capillary connector includes a cylindrical jacket device or segment carrier that is fitted by a dented internal superficial portion or catching segment that is fixed to the end of the tubing, providing a lock to assemble to the end of the flexible tubing with another device or bottom-hole tool. The dentated segment adheres to the external wall of the capillary by pressure exerted by a fitting thread.

A dart locking section assembly, comprises: a piece with socket seat made up of an elastomeric seal; a socket ring and a bumper—that is located in the end or toe of dart, fitted to said displacement dart, for being sent from surface to clean the tubing before the injection of steam and blinding the lower end of the flexible tubing introduced into the well; and a metal nose to which a fluttered elastomer tail is fitted so that, when sent from the upper end of the tubing on surface and by means of pumping fluid or steam, it is impelled by the interior of the tubing to the lower end, where it is fit in the socket seat sealing fully closing off the end of the tubing. After said dart locking section, the foot valve is fixed, which prevents the entrance of well fluids to the interior of the flexible tubing, forming a one way valve, that allows the passage of fluid downwards and prevents the passage of fluid upwards. Two pieces make up a cavity that houses a sphere that, when receiving downward pressure, is opened and, when receiving upwards pressure, it is closed.

An injection point in the lower end of the bottom-hole tools set, is connected to foot valve and includes a cylindrical body with the lower end forming a conical end of acute angle that facilitates the insertion of the bottom device in the well. A series of reduced lateral holes which connect to the camera and blow out the upward fluid producing a jet effect when steam comes out of the flexible tubing, for releasing steam, such that when coming out of the lateral holes, the steam acquires great speed, facilitating the removal of high viscosity petroleum layers during operation.

(6) In a variant, a method for steam generation and injection by means of injector wellhead hanger of coiled jacketed capillary tubing with closed circuit and procedure for operation in oil wells, comprises: placing an a previously mentioned self-contained portable unit for steam generation of and supporting said unit next to a well; turning the power plant on; transferring raw water from the reservoir tank to the softener plant; filling the treated water tank for feeding the boiler; laying tubing and hoses for the transport and steam injection to the well to be worked on; securing the tubing and hoses for steam transport to the well at high pressure; laying return hoses from well to reservoir tank; turning on the steam jenny and continuing the water feeding valves from low pressure circuits to exchanger; and turning on the centrifugal pump for filling and pressurizing the high pressure system and the high pressure system is filled and pressurized (A.P. pump and exchanger). wherein the recirculation of water feeding to the steam exchanger starts and the exchanger is loaded with steam.

(7) In another variant, the method or steam generation and injection by means of injector wellhead hanger of coiled jacketed capillary tubing with closed circuit and procedure for operation in oil wells, wherein the steam generation and injection unit is ready to feed the lines to the well and the method further comprises: the lower wellhead hanger is mounted on the upper valve of the blowout tree; the injector is mounted on the lower capillary tubing and the capillary tubing is inserted inside the riser; the steam line between generating unit and capillaries is filled; the steam blow-off valve to well steam conduction lines is opened; the steam line between generating unit and capillaries is filled; the capillary is filled with steam at minimum pressure securing the capillary tubing end for washing and blow-off of the injected fluid; the fluid injection to capillary tubing is fully cut; the assembly in the end of the capillary tubing of the set of bottom-hole tool is performed;

fluid is poured at minimum pressure to perform a system hermetism test; a working test of the system is performed by flushing fluid through the tool; secondary are checked for leaks; the riser is mounted with the bottom-hole tool on the lower wellhead hanger and the operating procedure to start lowering of the capillary is secured; the master valve is opened and checked for potential leaks and the capillary tubing trip begins; the system and steam injection are pressurized; the spray injecting is performed simultaneously with the down trip of the capillary; the capillary tubing is located in the preset depth threshold and the dart is introduced to block the fluid, and it is displaced to block the capillary tubing; a capillary tubing sealing pressure test is performed; the steam injection cut is performed, the capillary line and injector system line are depressurized; steam generation is stopped and the whole system is depressurized; the riser located on the lower wellhead hanger is disassembled and the capillary tubing is cut; the steam injection T body is mounted; a smaller wellhead hanger is mounted; the riser is mounted on the smaller wellhead hanger; diggers and approximation of hydraulic injector wellhead are performed to start the down trip of a smaller capillary tubing; the down trip of the smaller capillary tubing by smaller riser located over the body of the smaller wellhead hanger begins; the smaller capillary tubing is introduced through the annular space of the capillary tubing; the smaller capillary tubing in the preset depth threshold is located; the riser on the smaller wellhead hanger is disassembled; the smaller capillary tubing is cut; the smaller wellhead hanger lid is mounted; steam is generated in the jenny; the mounting operations are performed for the link assembly and the fluid flow lockout valve in the upper portion of the smaller wellhead hanger; the injection hose is connected to the T injection body and the fluid flow hose is connected on the return fluid flow lockout valve located on the smaller wellhead hanger; pressure is injected and the system is pressurized on the surface; pressures are equalized in the system and the well; the steam intake to the wellhead hanger is opened; fluid flows through the smaller capillary and return hose, heat energy recirculation takes place and the well's own fluid is stimulated, mobilizing the oil towards the surface by its own energy.

Other features and aspects of the invention will become apparent from the following detailed description, taken in conjunction with the accompanying drawings, which illustrate, by way of example, the features in accordance with embodiments of the invention. The summary is not intended to limit the scope of the invention, which is defined solely by the claims attached hereto.

BRIEF DESCRIPTION OF THE DRAWINGS

The present invention, in accordance with one or more various embodiments, is described in detail with reference to the following figures. The drawings are provided for purposes of illustration only and merely depict typical or example embodiments of the invention. These drawings are provided to facilitate the reader's understanding of the invention and shall not be considered limiting of the breadth, scope, or applicability of the invention. It should be noted that for clarity and ease of illustration these drawings are not necessarily made to scale.

Some of the figures included herein illustrate various embodiments of the invention from different viewing angles. Although the accompanying descriptive text may refer to such views as "top," "bottom" or "side" views, such references are merely descriptive and do not imply or require that the invention be implemented or used in a particular spatial orientation unless explicitly stated otherwise.

Figure 1:
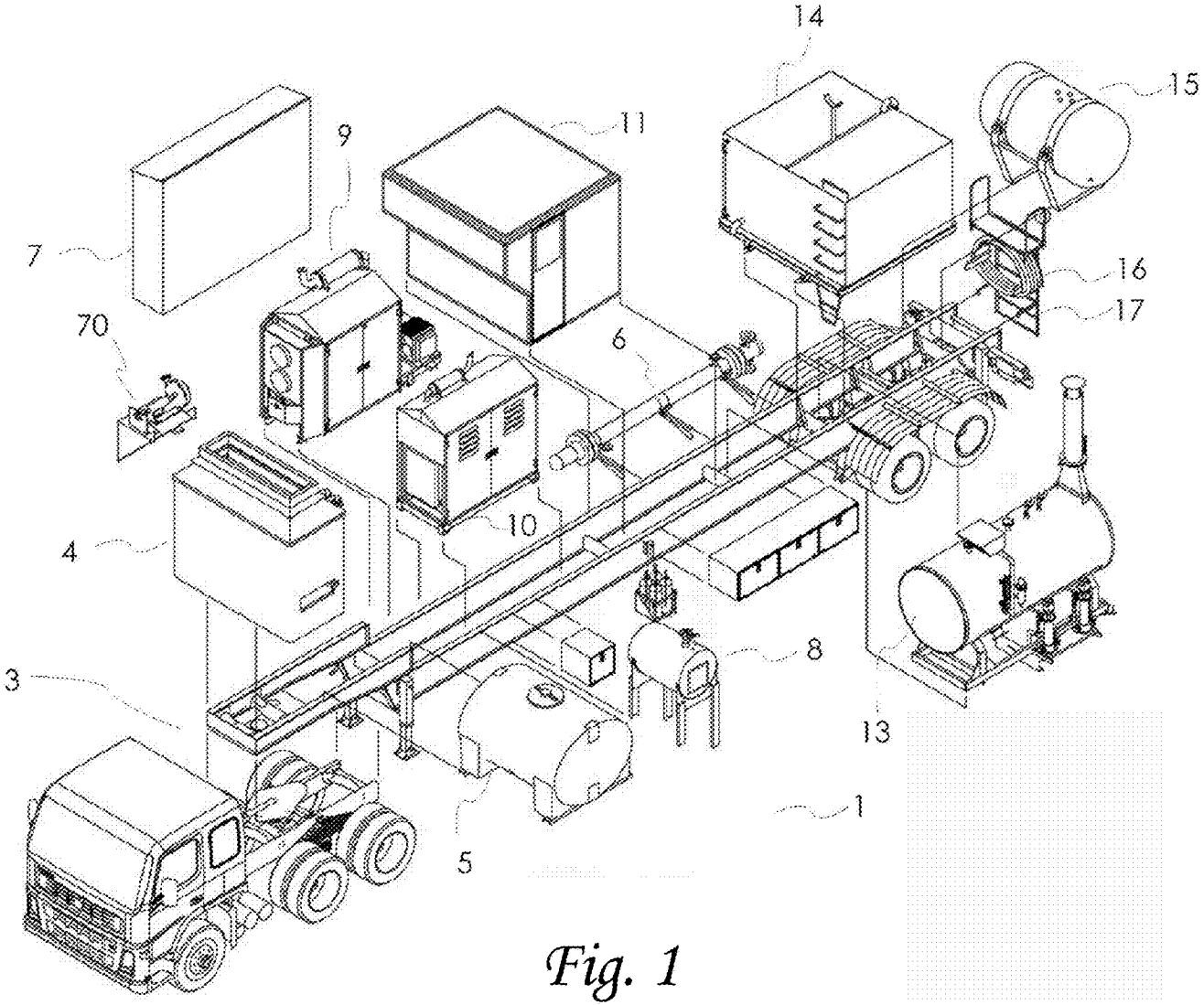

In order to render this patent easy to understand so that it can be easily put into practice, the following paragraphs detail the preferred performance manner, making reference to illustrative images that are attached, all of which includes, but it not limited to, the following:

FIG. 1 is a perspective view of the unit components which are placed on the chassis of the hauler showing the whole object.

Figure 2:
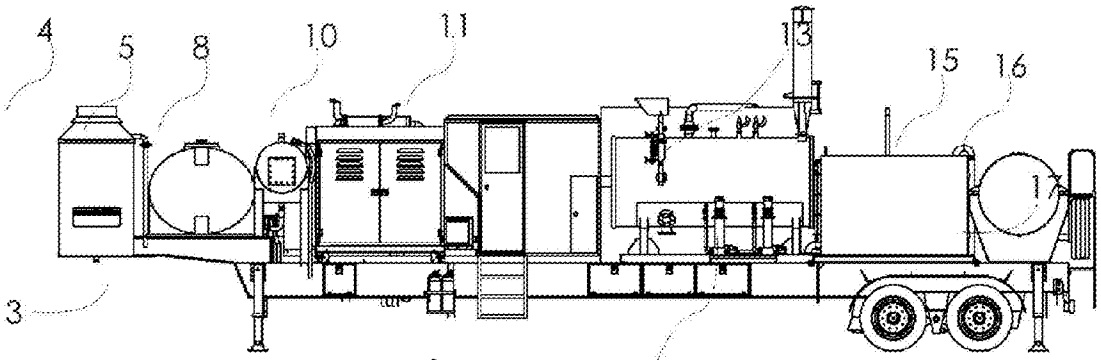

FIG. 2 is a side view of the unit components which are placed on the chassis of the hauler showing aspects of the parts layout.

Figure 3:
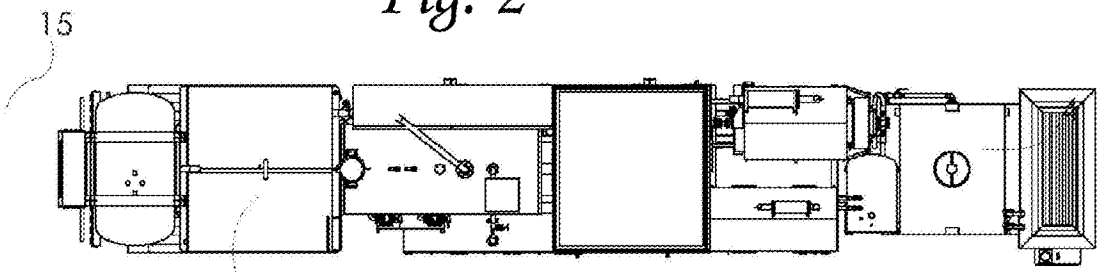

FIG. 3 is a top view of the unit components which are placed on the chassis of the hauler showing aspects of the parts layout.

Figure 4:
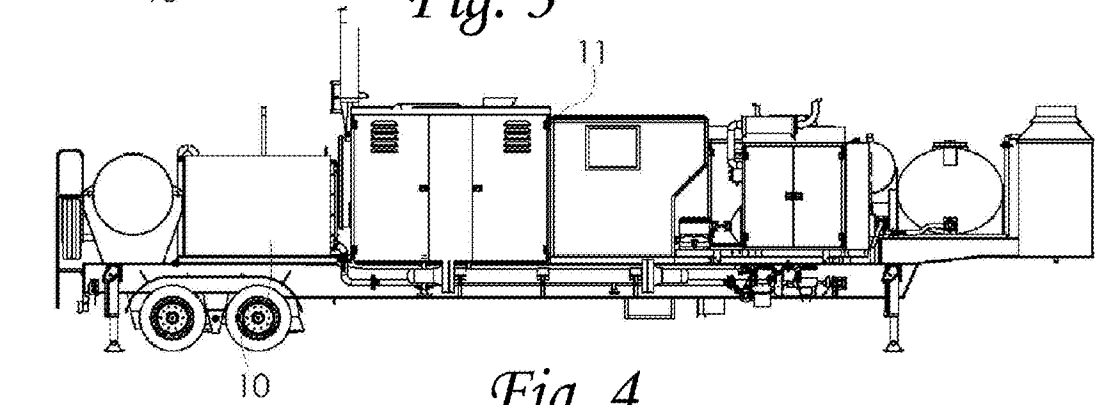

FIG. 4 is a side view of the unit components which are placed on the chassis of the hauler showing aspects of the parts layout.

Figure 5:
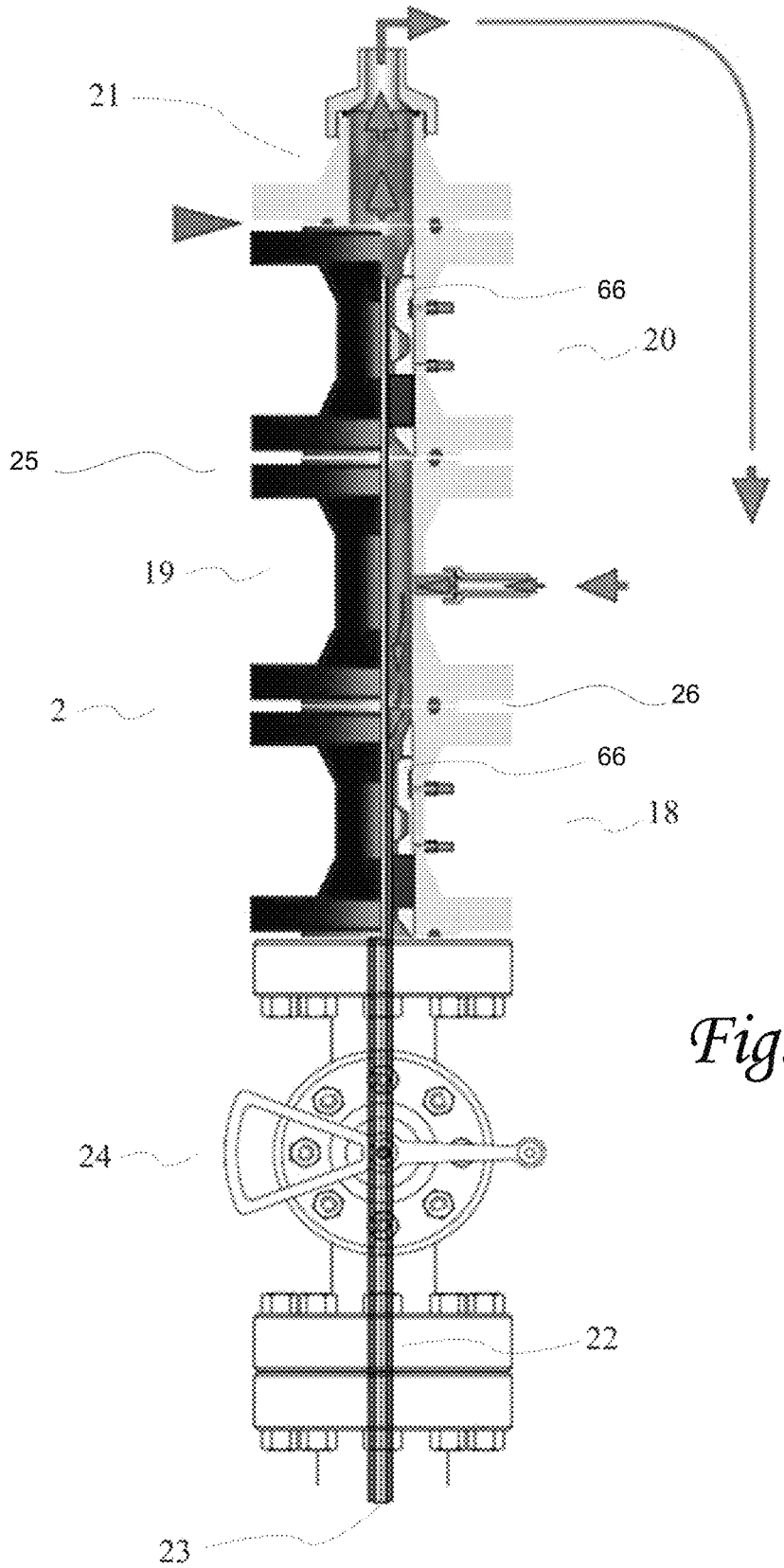

FIG. 5 is a side view in schematic sectional view of the well's head showing the layout of the modules and the circulation scheme of the fluids.

Figure 6:
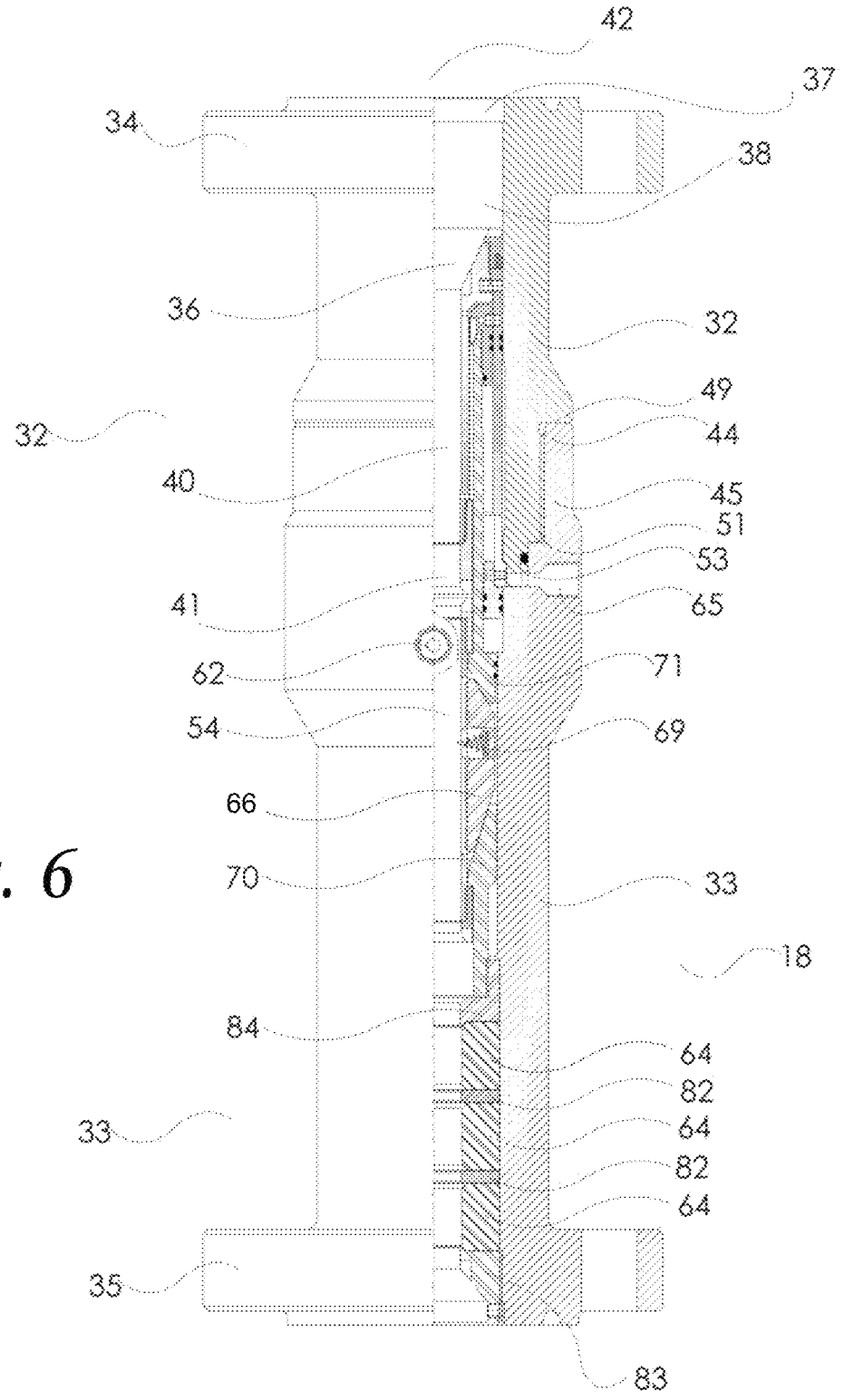

FIG. 6 is a side view and schematic sectional view of the lower hanging module for the ¾ capillary showing the layout of the casing elements, clamps and packing.

Figure 7:
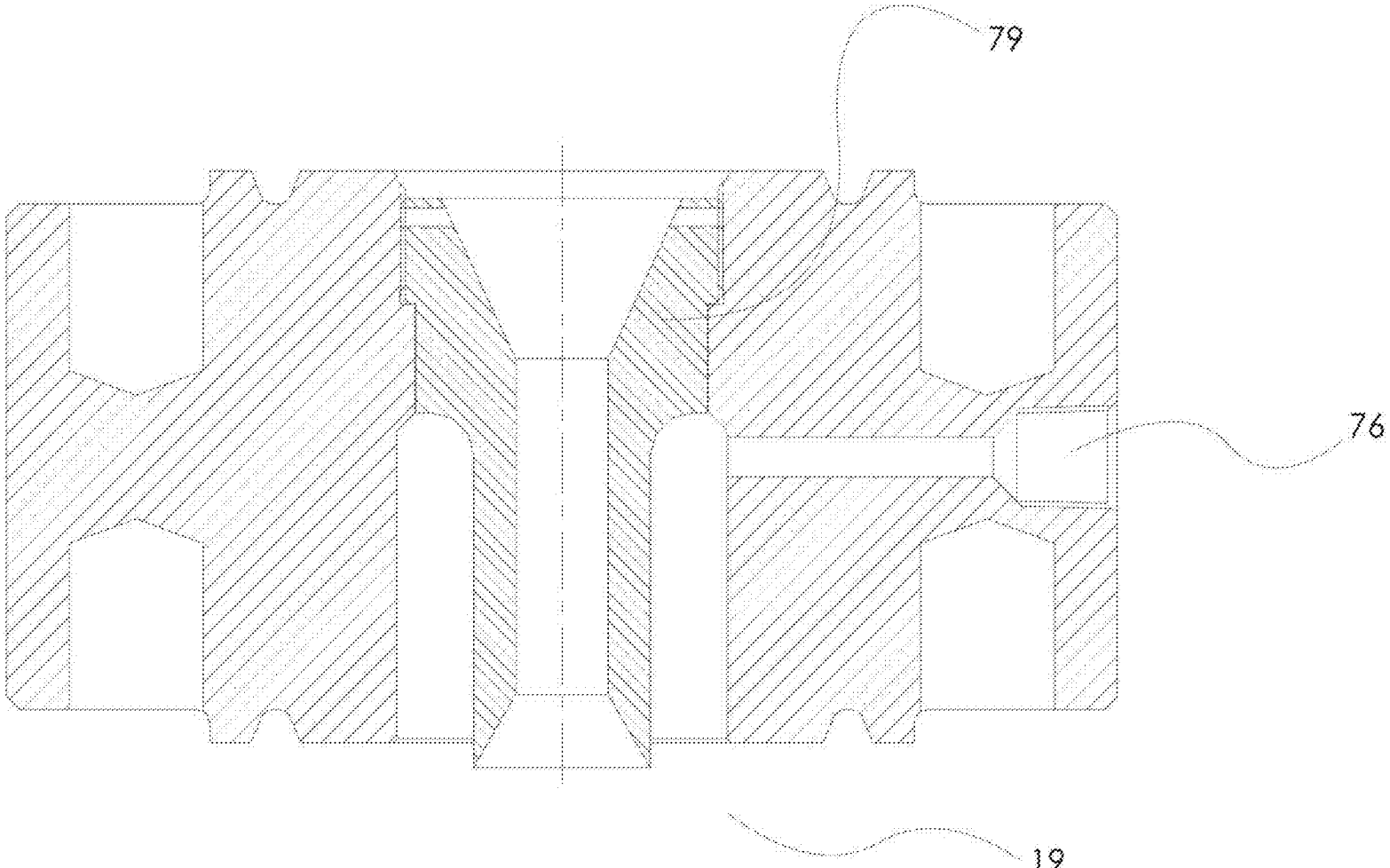

FIG. 7 is a view with sectional view of the injector module showing the layout of the elements, the protection jacket and the steam access port.

Figure 8:
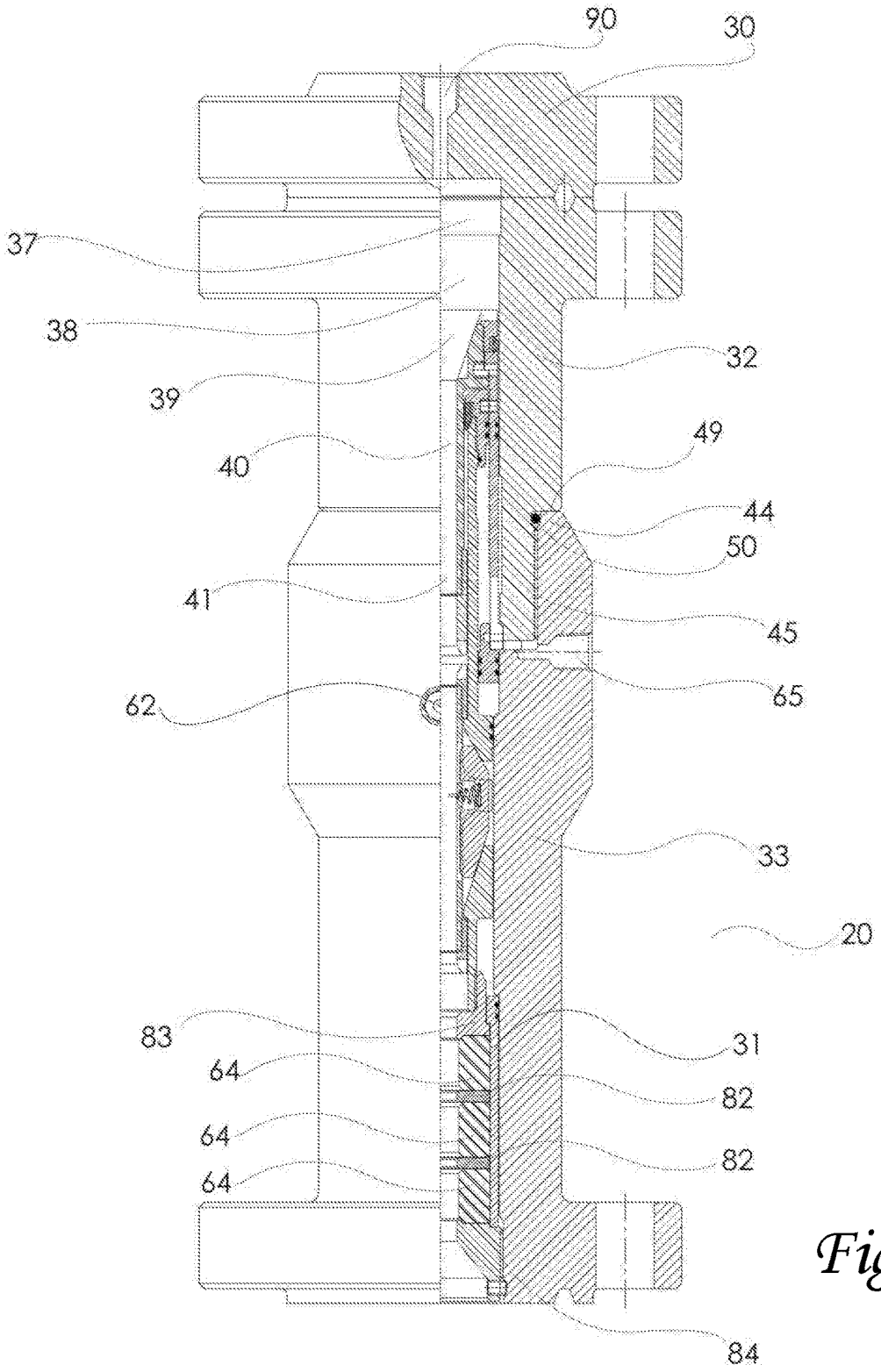

FIG. 8 is a side view and schematic sectional view of the upper hanging module showing the layout of the elements, casing, clamps and packing.

Figure 9:
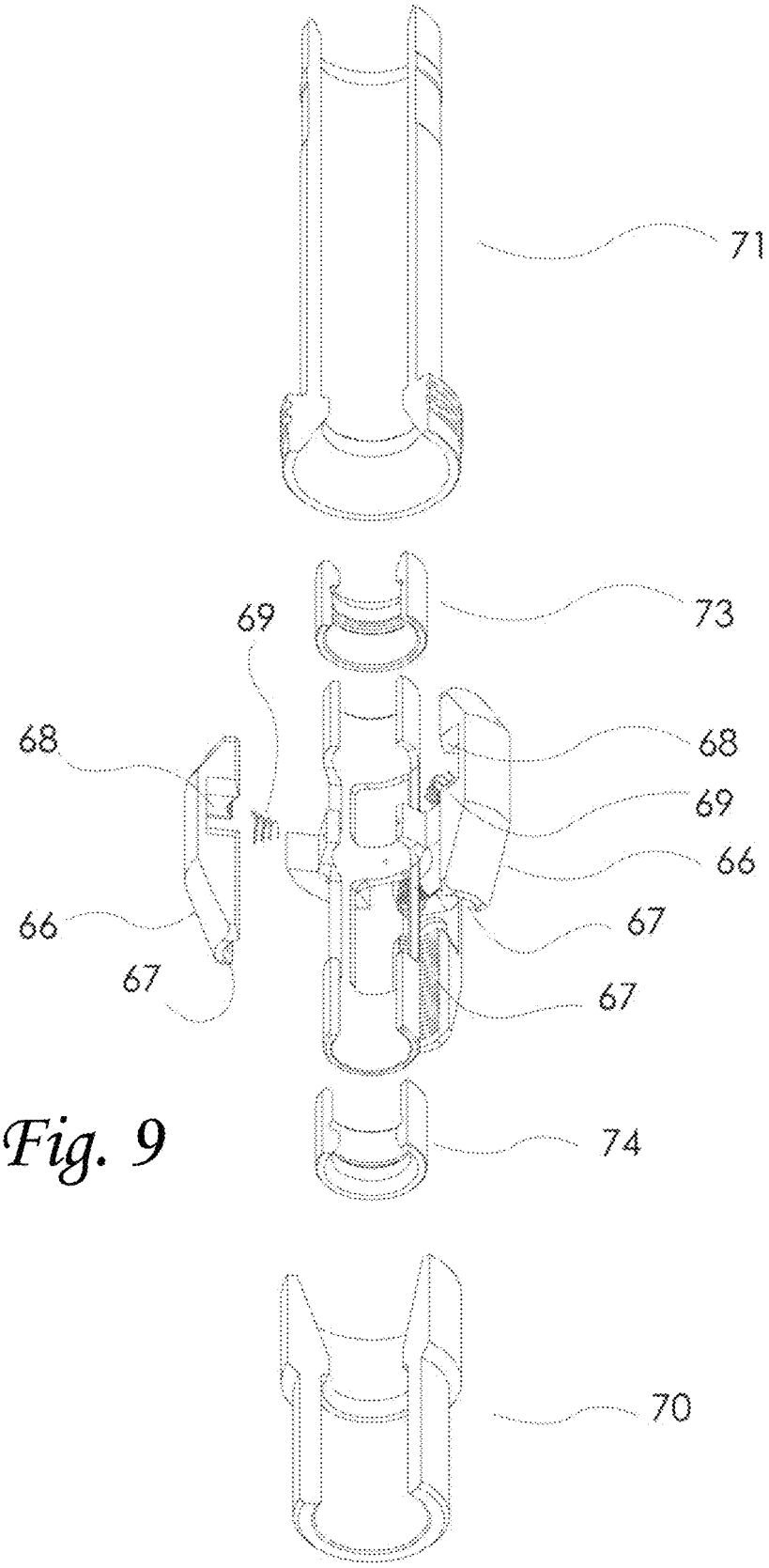

FIG. 9 is a perspective exploded view of the set of double clamps with schematic sectional view showing the layout of the elements, jackets, clamps and the cones morphology.

Figure 10:
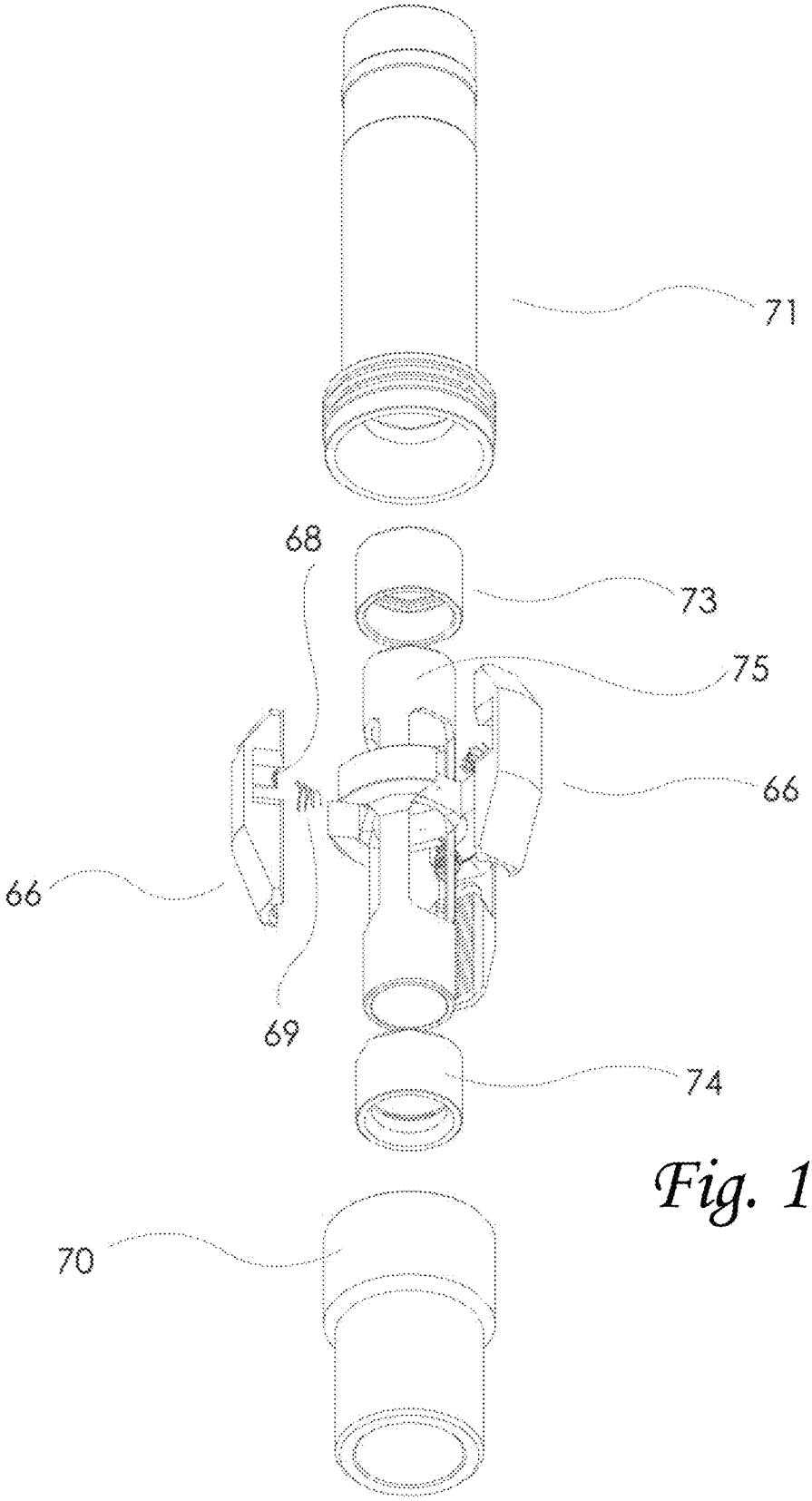

FIG. 10 is a perspective exploded view of the set of double clamps showing the layout of the elements, jackets, clamps and the cones morphology.

Figure 11:
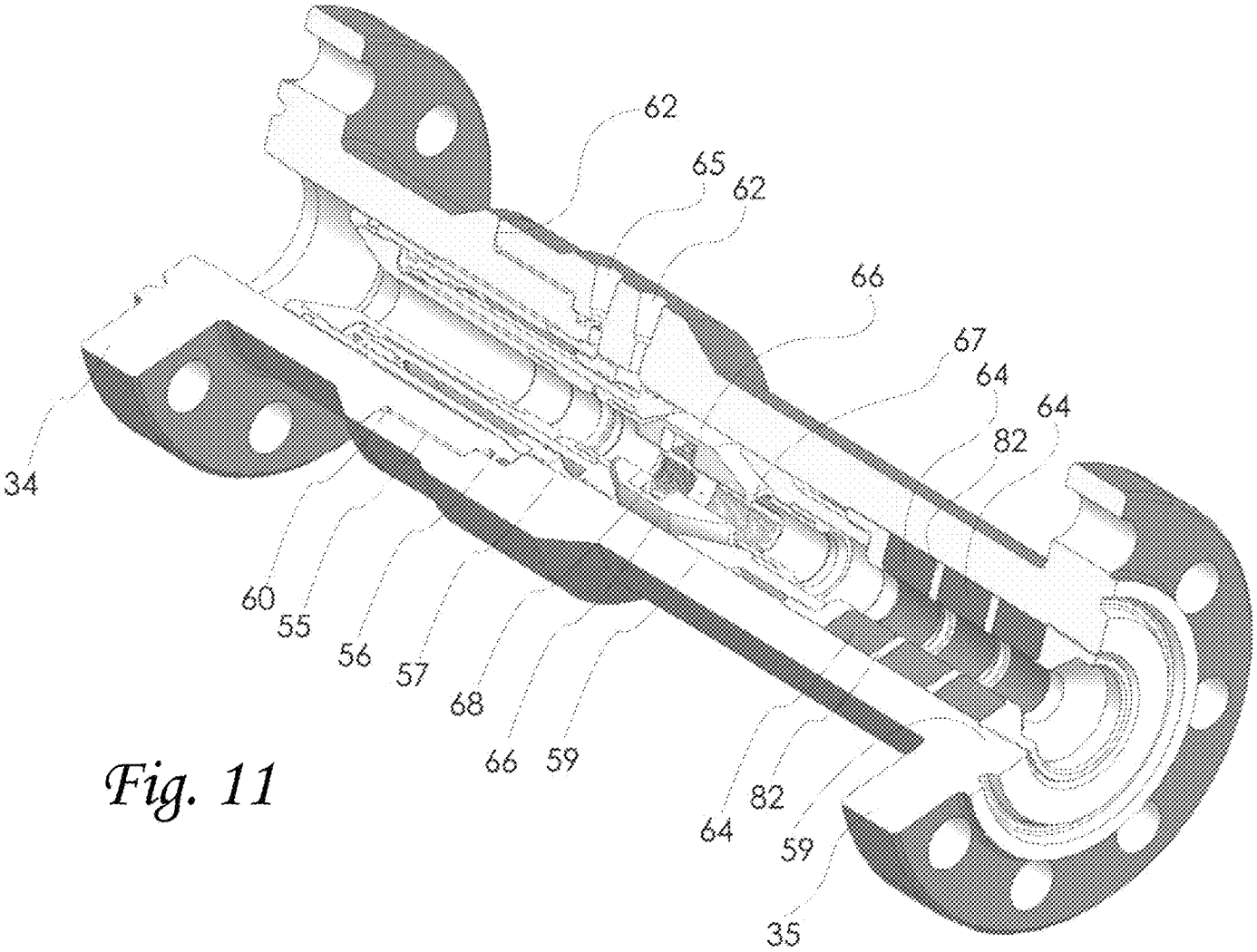

FIG. 11 is a perspective of the lower hanger with schematic sectional view showing the layout of the elements, casing, flanges, packing and hydraulic ducts.

Figure 12:
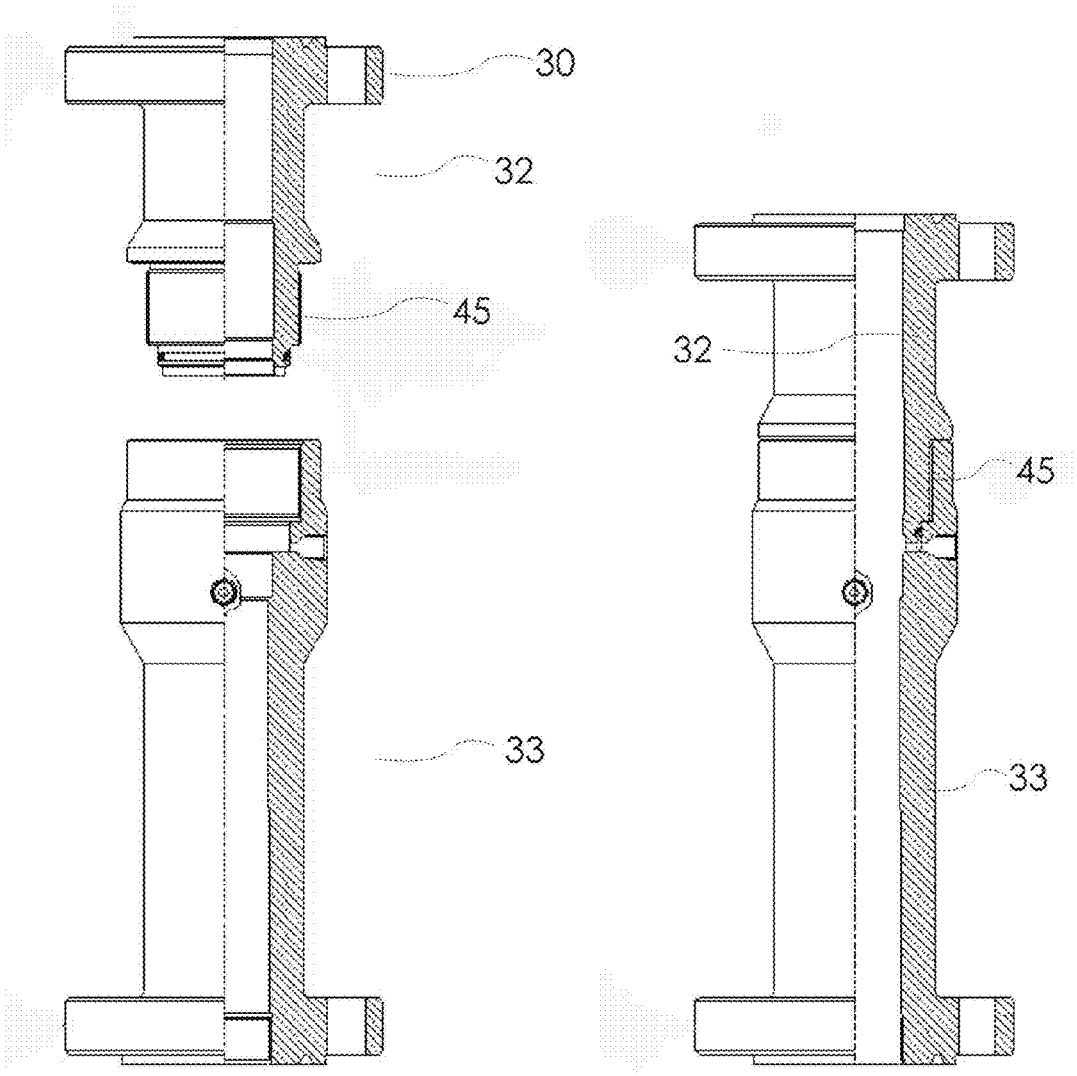

FIG. 12 shows two views with schematic sectional views illustrating the disassembled hanger and the assembled and threaded hanger.

Figure 13:
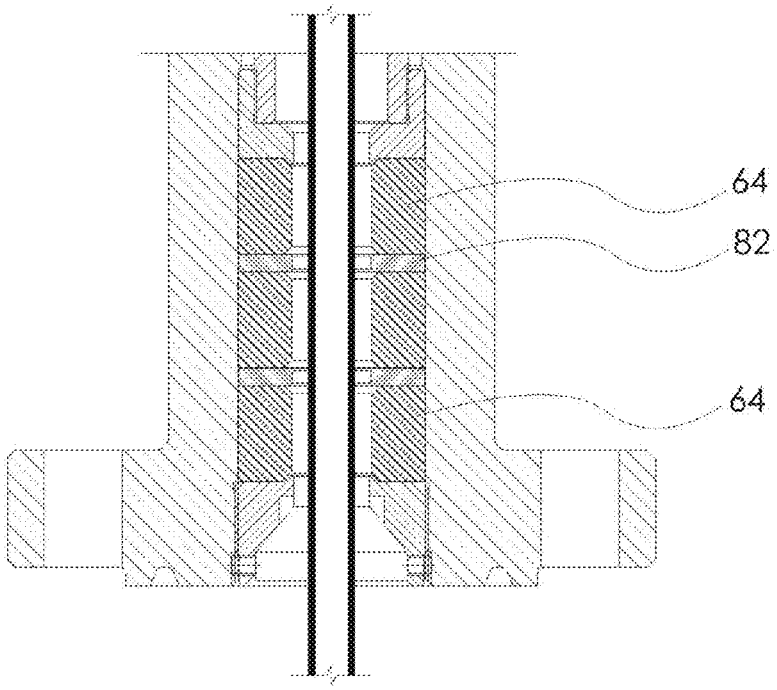
Figure 14:
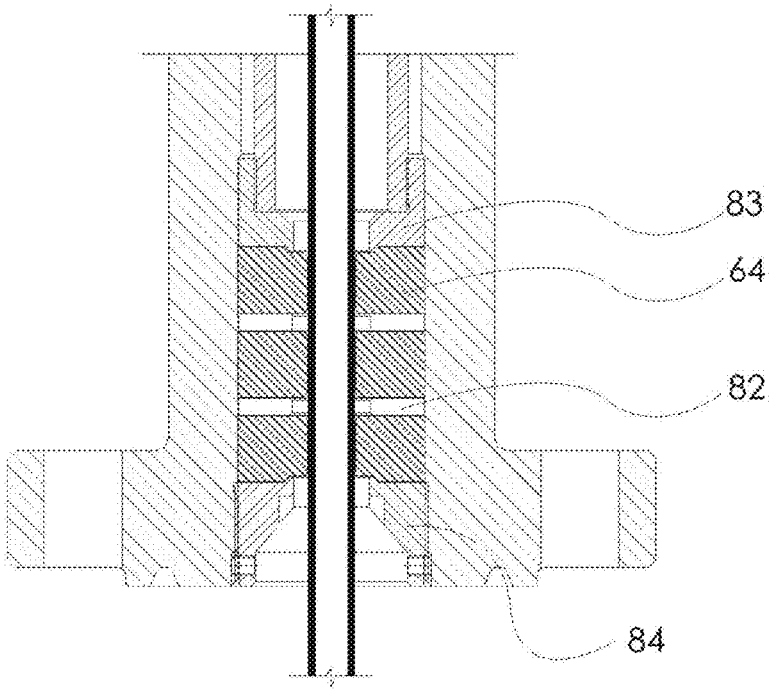

FIGS. 13 and 14 show two views with schematic sectional views illustrating the stretched set of rubbers extended towards the center of the module resulting from the hydraulic force.

Figure 15:
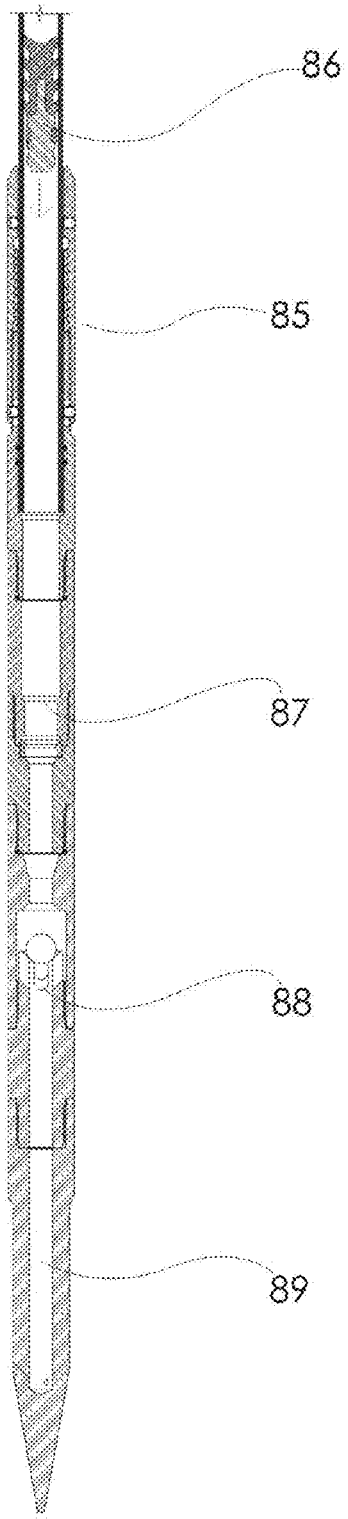

FIG. 15 shows a sectional view of the set of well bottom-hole tools illustrating how the different elements are linked and the downward dart is schematically placed.

Figure 16:
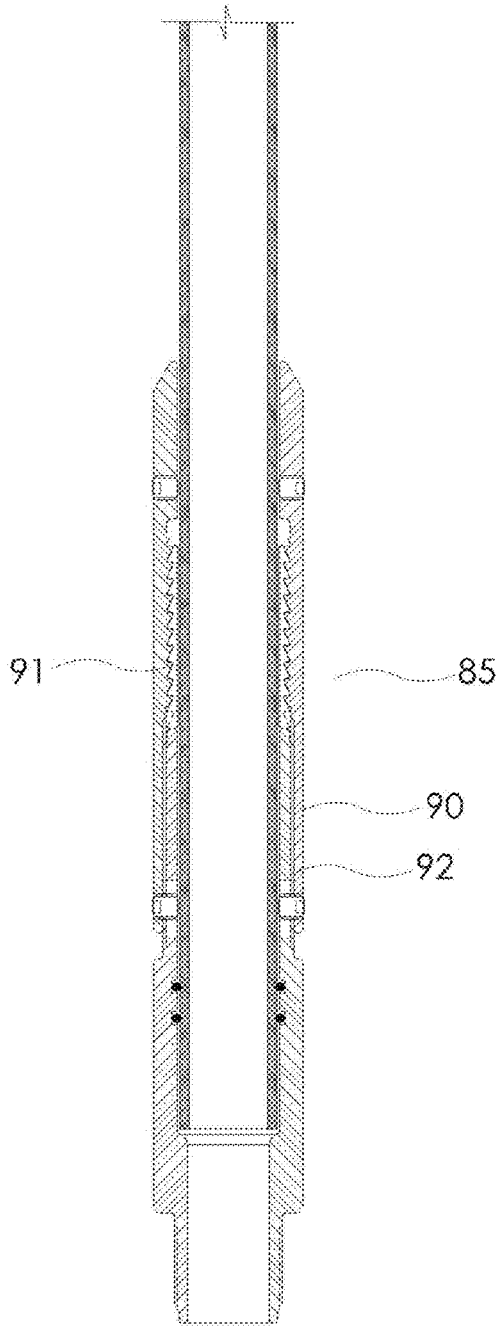

FIG. 16 shows a sectional view of the capillary connector with well bottom-hole tools illustrating how the different elements are linked and the capillary wall.

Figure 17:
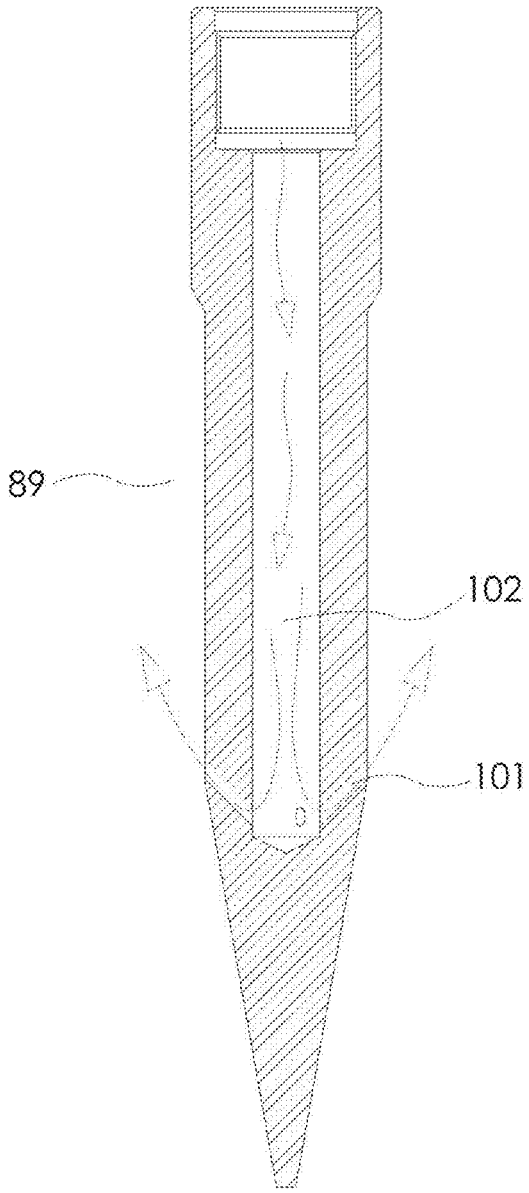
Figure 18:
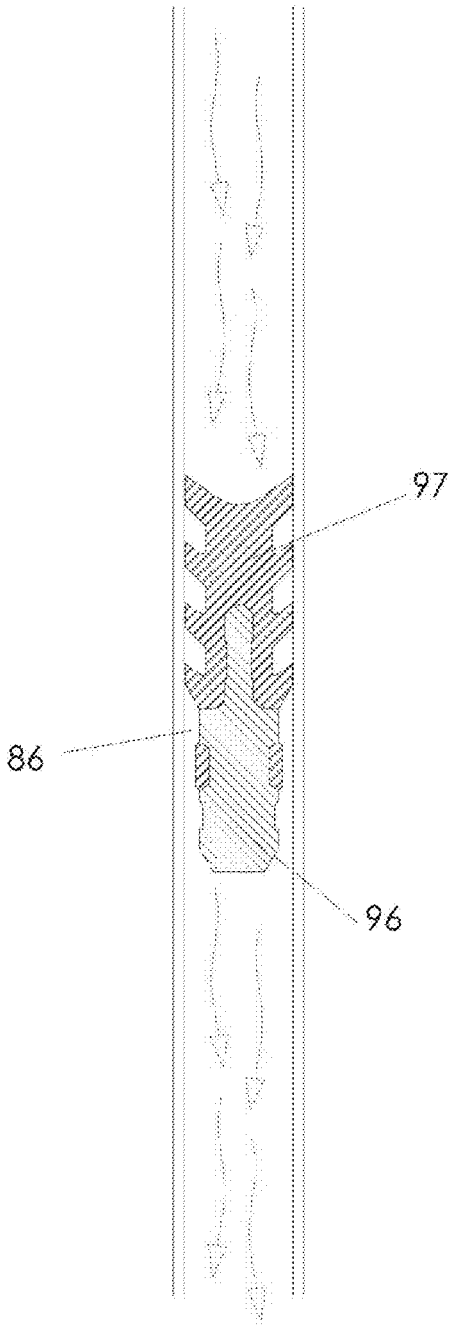

FIG. 17 shows a sectional view of the injection tip connector illustrating the chamber and injector ducts FIG. 18 shows a sectional view of the ¾ capillary schematically illustrating the dart in full downward movement driven through the heating fluid.

Figure 19:
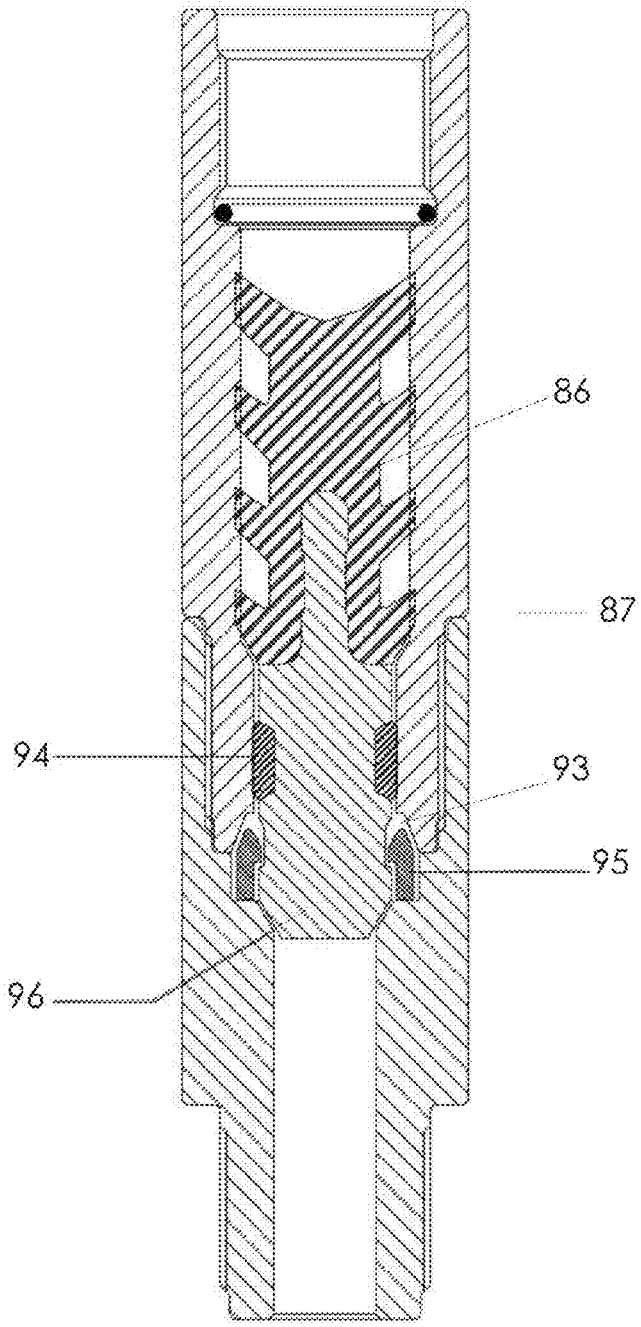

FIG. 19 shows a sectional view of the locking section schematically illustrating the dart in fixed position, already locked and fixed sealing the capillary.

Figure 20:
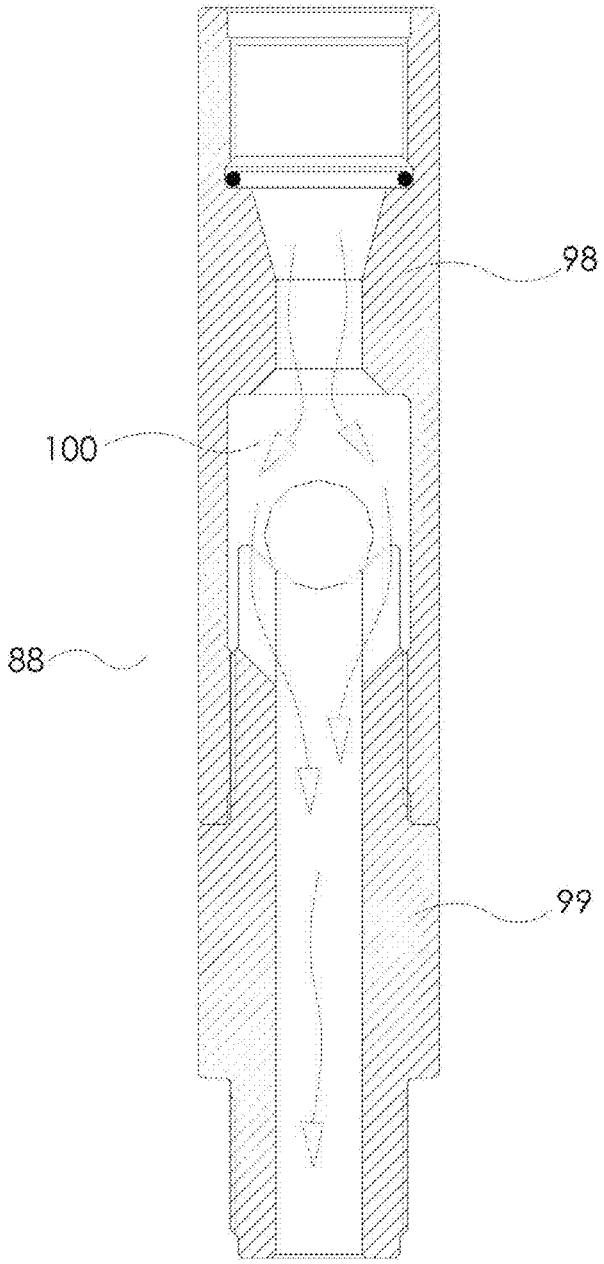

FIG. 20 shows a sectional view of the foot valve schematically illustrating the sphere in open position under the effect of heating fluid pressure.

Figure 21:
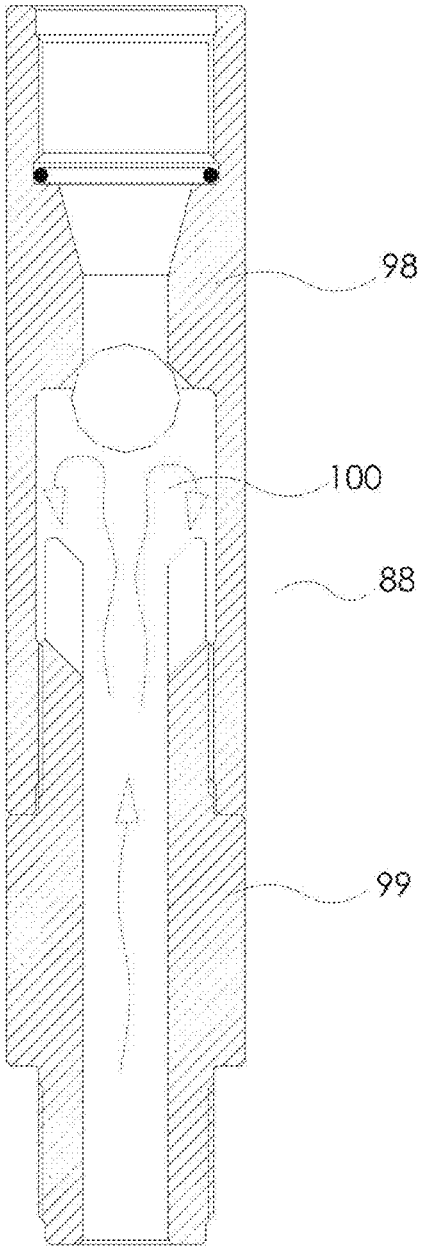

FIG. 21 shows a sectional view of the foot valve schematically illustrating the sphere in open position under the effect of well fluid pressure, in fixed position.

Figure 22:
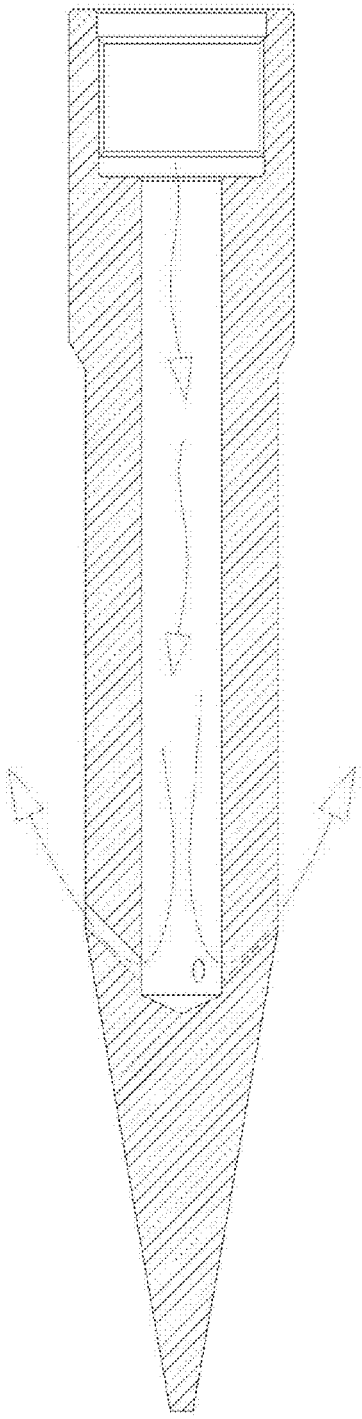

FIG. 22 shows a sectional view of the injector tip schematically illustrating the direction and effect of the heating fluid when the sphere is located in open position under the effect of those heating fluids.

The figures are not intended to be exhaustive or to limit the invention to the precise form disclosed. It should be understood that the invention can be practiced with modification and alteration, and that the invention be limited only by the claims and the equivalents thereof.

DETAILED DESCRIPTION OF THE EMBODIMENTS OF THE INVENTION

From time-to-time, the present invention is described herein in terms of example environments. Description in terms of these environments is provided to allow the various features and embodiments of the invention to be portrayed in the context of an exemplary application. After reading this description, it will become apparent to one of ordinary skill in the art how the invention can be implemented in different and alternative environments.

Unless defined otherwise, all technical and scientific terms used herein have the same meaning as is commonly understood by one of ordinary skill in the art to which this invention belongs. All patents, applications, published applications and other publications referred to herein are incorporated by reference in their entirety. If a definition set forth in this section is contrary to or otherwise inconsistent with a definition set forth in applications, published applications and other publications that are herein incorporated by reference, the definition set forth in this document prevails over the definition that is incorporated herein by reference.

In all figures, the same reference numbers refer to similar or corresponding elements. As shown in the drawings, the self-contained portable unit consists of a self-contained portable equipment for injecting heated fluids with capillaries in oil wells operations, a fully portable and self-contained equipment 1 for generating steam and dewaxing, a jacketed capillary hanging and injection head 2 and a set of bottom-hole tools, a hauler 3 equipped with two longitudinal beams that are connected by means of a series of beams that make up a rectangular frame construed of metal profiles on a rolling train to which a heat exchanger is placed cross-sectionallyto its frontal end 4 that is connected by tubing to a tank 5 that is juxtaposed to this one and cross-sectional to this hauler 3. This tank 5 feeds water to a heat exchanger 6 and a softener 7. Juxtaposed to this one, there is a centrifugal pump 70. Juxtaposed to this tank 5, cross-sectional to the chassis, there is a second tank 8 that feeds the lubricant by means of tubing section to an electric power generator 9 and an electrical generator 10. Juxtaposed to each other and longitudinally respect to the chassis, following these, there is a control cabin 11 and a fluids softener 12 connected by means of tubing section to a steam boiler 13 arranged longitudinally that it is connected by tubing section by means of which it is fed with water from a sink 14. Next and cross-sectionally, there is a fuel tank 15 that feeds propane liquefied gas to said to boiler 13. Finally, in the posterior end of the chassis there is a hose reel 16 that holds hoses 17, which, during the operation, connect with the hanging and injection head 2. This set is portable and self-contained, since all these components are adapted and fixed on a hauler 3 and do not require energy nor fluid supply whatsoever. This wellhead 24 includes three modules 18, 19 and 20 crowned with a cover 21, two of which, 18 and 20, are capillary hangers of different gauge capillaries and the rest is the injection module 19. This disposition provides a circulation circuit of the heating fluid through the columns entering, in this case, by three quarters (¾) tubing 22 and recovering by three eighths (⅜) capillary 23. Said hanging and injection head 2 is arranged to overlap the wellhead 24, being that said lower hanger module 18 is fixed by means of coupling yoke 25 to upper yoke 26 of the wellhead 24. Said hanging and injection head 2 houses a set of double clamps 66 that supports a greater section of the capillary of smaller diameter 23, in this case, three quarters (¾) of the outer diameter. The overlapping said hanging and injection head 2, attaches to the injection module 19 that offers access to the line of heated fluids connected to the equipment 1, by the corresponding coupling yokes. The upper hanger module 20 is attached by the respective coupling yokes, which houses the capillary of smaller diameter 23, in this case, of ⅜, which is fixed and hung by means of a double clamp 66 and jacketed by the greater capillary 22. Crowning the wellhead, there is a cover with a duct 30 for steam disposal 90. Said lower 18 and upper 20 hanger modules present identical morphologies, except for a rubber-carrying jacket 31 that is arranged on said upper hanger module 20. Both hangers have the same number and morphology of components that make up these two main 32 and 33 threaded pieces which make up one external casing. These two pieces 32 (upper body) and 33, (lower body) are fixed to each other by means of a thread and seal (0-ring), making up a vertical cylindrical structure with upper and lower connection by means of yokes. These bodies 32 and 33 (named yoke body) are of cylindrical configuration in whose respective ends have a projecting annular portion offering one coupling yoke 34 and 35. This final portion 32 includes a cylindrical cavity 36 of five portions 37, 38, 39, 40, 41 of different diameters. This portion 37 arranged in the upper end offers a circular collar 42, followed by a portion 38 of smaller diameter and greater length. Said second portion 38 is followed by one third portion 39, with a diameter equal to said first portion 37. Next, there is a portion 40 of equal length to this first portion 37, following this, the remaining portion 41 is placed on the end opposed to yoke 34, finished with a beveled edge that it is connected with cavity of the yoke lower body 33. For locking this upper body yoke 32, there is a ninety-degree-stope 44 followed by a threaded wall 45. Said ninety-degree-stope offers an annular surface 49 that comes in contact with this yoke body 33 and one dap 50 that circles the wall housing the joint. Following this thread, there is a second rounded ninety-degree-border 51 followed by a second ninety-degree-stope that ends in a beveled edge collar 53 that connects with the cavity of the lower body yoke 33 that has a cylindrical cavity 54 with five portions, 55, 56, 57, 58, 59, with different diameters. Said portion 55 arranged in the upper end offers a collar whose upper perpendicular border 60 has an annular surface 49 that fully connects with said border. Said face 60 is followed by a beveled border, followed in turn by said portion in such a way that its face is locked to said face 51. Following the face of said portion 55, there is a portion 56 with a slightly smaller diameter. Between them, at ninety degrees, there is an annular border on which the upper piece is placed 32. Said portion 56 is followed by a portion 57 with smaller diameter and longer, having a ninety-degree-joint border. Then, there is portion 58 with slightly bigger diameter, finishing in a right angle border that is before said portion 59 and offers the collar that connects the cavity of the wellhead with the master valve and it, in turn, is connected to the blowout preventer 24. Both modules, 18 and 20, house in their respective cavities a double clamp 66. These double clamps hold and pack capillaries 22 and 23 which hang inside the tubing. The lower hanger module 18 holds the capillary of greater section (of ¾), and the upper hanger module 20 holds to the smaller capillary (⅜) that hangs jacketed by this greater capillary. Said double clamps 66 are driven by means of hydraulic fluid that confers the packing force applied between capillaries 22 and 23 and the respective lower hanger module 18 and yoke 25, thus the pressure can exactly be regulated, monitored and modified when necessary, even during the production procedure. For this purpose, the lower body 32 of the respective hanger modules has two side holes 62 and 65 that are connected to a pressure pump. Hole 62 received the hydraulic fluid with pressure and leads it to the double clamp that drives and locks up to the capillary with the gear and packs it with the compression of elastomers 64 simultaneously, whereas hole 65, once opened, spills the hydraulic fluid deactivating the double clamps and the packing, releasing the capillary. The double clamps 66 is made up of three dentate clamps 66 which are radially placed in a clamp holding tubular jacket 65, so that their inner faces 67 of cylindrical concave configuration are equipped with a cross-sectional succession of highly hard teeth which make up a friction surface that, when moving towards the center of the module by displacement of double clamp 66, holds the capillary adjusting to its diameter and fitting the tubing. Each double clamp 66 has in their interior a groove or central valley 68 that divides two portions of the clamp, an upper and a lower one. The upper portion prevents the tubing from slipping upwards, and the lower portion prevents the tubing from slipping downwards. This is the principle that determines the double grasp clamp. Each double clamp 66 has a clamp spring 69 that is located in this central valley 68. This spring 69 keeps the clamp expanded, that is to say, with their external face close to the internal wall of the respective hanger module. When the clamps are closed by effect of the movement of the cones, the springs are compressed, and the clamps return to their position by effect of the decompression of these springs. In the ends of the set there are two tubular cylindrical pieces 70 and 71 called lower clamp 70 and upper clamp 71 cones. Each cone has in its end next to the clamp a truncated cone shaped internal portion whose dimensions exactly match the dimensions of the external face also of truncated cone shaped portion of each respective clamp. When the clamp is driving by hydraulic pressure, this upper cone 71 moves in downwards coming near to lower cone 70. Thus said three clamps are gradually incorporated into this truncated cone shaped cavity moving towards center of the module reducing the inner diameter and clamping the tubing. The double-clamps 66 have two jacket buffers, an upper jacket buffer 73 and a lower jacket buffer 74. These are solidary to the clamp carrying jacket 75, and fix the cones to the jacket, keeping the set together so that they prevent the displacement of the cones when being distanced, maintaining all the pieces tied. Said injection T-module 19 is arranged interposed respect to said lower hanger module 18 and said upper hanger module 20. It has a lateral access duct 76 by which heating fluid is injected (steam/water) from the boiler; thus this module 19 is the injector of the wellhead. Its body is of tubular configuration in whose corresponding opposite ends they have an annular portion salient respect to the cylindrical wall offering two yokes, one upper yoke that connects to the lower yoke of the upper hanger module 20 and one yoke that connects to the upper yoke of the lower hanger module 18. This module 19 injects heating fluid between the capillaries. In its interior, it is equipped with a heavy-duty sacrificial jacket 79 that supports the change of direction of heating fluid and the possible erosion that this can cause to the ¾ capillary 22. This technology allows for the circulation of heating fluids at high temperatures and pressures, crowning the hanging and injection head 2 and fixed overlapping the upper hanger module 20. A closing lid is coupled by means of a yoke with screws 21 that has a return hole that leads the steam or heating fluid to a hose connected to the portable unit equipment 1 recovering said fluid that is coming up from the well, having in this way a closed circuit, since the fluid does not come in contact with the well fluids and pressures. On the other hand, said double clamps 66 allow to regulate the packing force even after the production process is started. The packing set is made up of a rubber holding jacket 31 that loosens three rubber screws 64 and two space rings 82 that are located between these rings, an upper retaining ring 83 and a lower bumper 84. These elastomer rings 84 are built with a flexible high temperature compound that is easily compressed or expanded. The inner diameter of these rings supports the internal passing of the hanger, through which the flexible tubing passes. The external diameter of these rings matches the inner diameter of the lower body yoke where they are located overlapping and separated from each other by these two rings 82 that contain them at the time of compression. Over the rubber pack 64, there is said upper retainer ring 83 that is the support and anti-extrusion barrier of the rubber at the time of compression. Underneath the rubber package, there is a lower bumper 84 that supports and backs up the rubbers in compression state. This ring is solidary to the lower body and lacks movement. The packing set seals and closes off the annular space between the outer diameter of the flexible tubing and the inner diameter of the hanger body, generating a barrier in the annular space of the well. This packing set activates when receiving an axial load, that is to say, with force applied downwards on the upper retaining ring 83 transmitting to the rest of the pieces arranged underneath. This load generates a compression on rubbers and they react expanding their volume concentrically towards the blowout zone, that is to say, the center, until making contact and pressure against the flexible tubing located inside of the hanger, obtaining packing on the capillary. This axial load results from the applied hydraulic pressure through the lower hole that is in the lower body, simultaneously driving the clamps and the rubber set. In order to complete the unit, and essential part of this invention, i.e., the steam or heating fluid injection closed circuit in the required depth of the well, it was necessary to solve a series of problems. This is why a set specially designed well bottom tools was added in the end of the tubing, which consists of a capillary connector 85, a displacement dart 86, a dart socket 87, a foot valve, a check valve 88 and an injection point 89. This capillary connector 85 includes a cylindrical jacket device or segment carrier 90 that is fitted by means of a dented internal superficial portion or catching segment 91 that is fixed to the end of the tubing providing a lock to assemble to the end of the flexible tubing with another device or bottom-hole tool. For such aim, this dentated segment adheres to the external wall of the capillary by means of pressure exerted by a fitting thread 92. Then a dart locking section is assembled 87 consisting of a piece with socket seat 93 made up of an elastomeric seal 94, a socket ring and a bumper 95 that is located in the end or toe of dart 96, fitted to said displacement dart 86 that is sent from surface to clean the tubing before the injection of steam and blinding the lower end of the flexible tubing introduced into the well. This is made up of a metal nose 96 to which a fluttered elastomer tail is fitted 97 so that, when sent from the upper end of the tubing on surface and by means of pumping fluid or steam it is impelled by the interior of the tubing to the lower end, where it is fit in this seat 93, sealing fully closing off the end of the tubing. After said dart locking section, the foot valve 88 is fixed, which prevents the entrance of well fluids to the interior of the flexible tubing. This is a one way valve, that is to say, that allows the passage of fluid downwards and prevents the passage of fluid upwards. In order to do this, it has two pieces that make up a cavity that houses a sphere that, when receiving downward pressure, is opened and, when receiving upwards pressure, it is closed. Finally, and injection point 89 is located, which is installed in the lower end of the bottom-hole tools set, connected to foot valve 88, and it includes a cylindrical body with the lower end forming a conical end of acute angle that facilitates the insertion of the bottom device in the well. To release steam, there is a series of reduced lateral holes 101 which connect to the camera 102 and blow out the upward fluid producing a jet effect when steam comes out of the flexible tubing. When coming out of the small holes, the steam acquires great speed, facilitating the removal of high viscosity petroleum layers. The procedure to operate the self-contained portable unit is the following: after investigation and engineering of each well to be worked on, by means of the heat transfer technique at preset depths, made by means of the steam injection by placing a coiled jacketed capillary tubing; Location near the self-contained portable unit well for generating steam and supporting equipment; Commissioning of the power plant; Transferring raw water from the reservoir tank to the softener plant; Loading of treated water tank for feeding the boiler; Laying of tubing and hoses for the transport and steam injection to the well to be worked on; Securing of tubing and hoses for steam transport to the well at high pressure; Laying of return hoses from well to reservoir tank; Commissioning of the steam jenny unit; Opening of water feeding valves from low pressure circuits to exchanger; Switching on of centrifugal pump for filling and pressurizing of the high pressure system; Filling and pressurizing of high pressure system (high pressure pump and exchanger); Starting re-cycling from water feeding system to exchanger, loading of steam to exchanger, steam generating unit and injection ready to fill the lines to well; Assembling the ¾ hanger in blowout tree upper valve; Assembling riser over ¾ lower hanger; Starting placing the capillary tubing inside the riser; Connecting the steam line in the generating unit; Opening the steam blow-off valve to well steam conduction pipes; Filling of steam line between generating unit and capillaries; Filling of ¾ capillary steam at minimum pressure securing the capillary tubing end for washing and blow-off of the injected fluid; Fully cutting fluid injection to capillary tubing. Assembling in the end of the ¾ capillary tubing of the set of bottom-hole tool; Loading fluid at minimum pressure to perform the system hermetism test; Performing working test of the system with fluid flow through the tool; Checking for secondary leaks; Assembling the riser with the bottom-hole tool on the lower ¾ hanger; Securing the operating procedure to start lowering of the capillary; Opening the master valve, checking for leaks; Starting lowering the ¾ capillary tubing; Pressurizing the system and steam injection; Spray injecting simultaneously with the lowering of the capillary; Locating the capillary tubing in the preset depth threshold; Introducing the ¾ dart to lockout fluid; Displacing the dart until the capillary tubing is sealed; Testing the capillary tubing sealing pressure; Stopping the steam injection, depressurizing the capillary line and the injection system; Stopping for steam generation and depressurizing the entire system; Disassembling the riser (device belonging to the capillary technical unit), located on the ¾ lower hanger; Cutting the capillary tubing at ¾ diameter; Assembling the steam injection T body; Assembly of ⅜" wellhead hanger; assembly of riser (device belonging to the capillary technical unit), over the ⅜" wellhead hanger body; Readiness and approximation hydraulic injector wellhead of capillary technical unit to start the down trip of the ⅜" capillary tubing; Beginning of down trip of ⅜" capillary tubing by ⅜" riser located over the body of the ⅜" wellhead hanger; Displacement of ⅜" capillary tubing through annular space of ¾" capillary tubing; Location of ⅜" capillary tubing in preset depth threshold Disassembly of riser (device belonging to the capillary technical unit) located on a ⅜" wellhead hanger body; Cutting the ⅜ capillary tubing; Assembling the ⅜ hanger close lid; Starting steam generation in the generating unit; Retreating the technical unit of the capillary from the worked on well; Readying the linking assembly and the fluid flow lockout valve in the upper portion of the ⅜" hanger; Assembling the steam injection hose in the T body of the injection; Assembling the hose to conduct the return fluid in the fluid flow lockout valve located on the ⅜" hanger; Injecting pressure and pressurizing the system on the surface; Equalizing pressures in the system and the well; Opening the steam intake to the ¾" hanger; Out flowing fluid through the ⅜" capillary and return hose; Starting the heat energy recirculation; and Stimulating the well's own fluid, mobilizing oil to the surface by its own power.

While various embodiments of the present invention have been described above, it should be understood that they have been presented by way of example only, and not of limitation. Likewise, the various diagrams may depict an example architectural or other configuration for the invention, which is done to aid in understanding the features and functionality that can be included in the invention. The invention is not restricted to the illustrated example architectures or configurations, but the desired features can be implemented using a variety of alternative architectures and configurations. Indeed, it will be apparent to one of skill in the art how alternative functional, logical or physical partitioning and configurations can be implemented to implement the desired features of the present invention. Also, a multitude of different constituent module names other than those depicted herein can be applied to the various partitions. Additionally, with regard to flow diagrams, operational descriptions and method claims, the order in which the steps are presented herein shall not mandate that various embodiments be implemented to perform the recited functionality in the same order unless the context dictates otherwise.

Although the invention is described above in terms of various exemplary embodiments and implementations, it should be understood that the various features, aspects and functionality described in one or more of the individual embodiments are not limited in their applicability to the particular embodiment with which they are described, but instead can be applied, alone or in various combinations, to one or more of the other embodiments of the invention, whether or not such embodiments are described and whether or not such features are presented as being a part of a described embodiment. Thus the breadth and scope of the present invention should not be limited by any of the above-described exemplary embodiments.

Terms and phrases used in this document, and variations thereof, unless otherwise expressly stated, should be construed as open ended as opposed to limiting. As examples of the foregoing: the term "including" should be read as meaning "including, without limitation" or the like; the term "example" is used to provide exemplary instances of the item in discussion, not an exhaustive or limiting list thereof; the terms "a" or "an" should be read as meaning "at least one," "one or more" or the like; and adjectives such as "conventional," "traditional," "normal," "standard," "known" and terms of similar meaning should not be construed as limiting the item described to a given time period or to an item available as of a given time, but instead should be read to encompass conventional, traditional, normal, or standard technologies that may be available or known now or at any time in the future. Likewise, where this document refers to technologies that would be apparent or known to one of ordinary skill in the art, such technologies encompass those apparent or known to the skilled artisan now or at any time in the future.

A group of items linked with the conjunction "and" should not be read as requiring that each and every one of those items be present in the grouping, but rather should be read as "and/or" unless expressly stated otherwise. Similarly, a group of items linked with the conjunction "or" should not be read as requiring mutual exclusivity among that group, but rather should also be read as "and/or" unless expressly stated otherwise. Furthermore, although items, elements or components of the invention may be described or claimed in the singular, the plural is contemplated to be within the scope thereof unless limitation to the singular is explicitly stated. In addition, when a single callout line in the drawings leads to two or more separate reference numbers (first, second, etc. reference numbers), (and each reference numeral refers to a different piece of text in the detailed description) and it would be inconsistent to designate the drawing item being called out as both pieces of text, the drawing be interpreted as illustrating two different variants. In one variant, the drawing item is referred to by the first reference number and in another variant the drawing item is referred to by the second reference number, etc.

The presence of broadening words and phrases such as "one or more," "at least," "but not limited to" or other like phrases in some instances shall not be read to mean that the narrower case is intended or required in instances where such broadening phrases may be absent. The use of the term "module" does not imply that the components or functionality described or claimed as part of the module are all configured in a common package. Indeed, any or all of the various components of a module, whether CTRL logic or other components, can be combined in a single package or separately maintained and can further be distributed across multiple locations.

Additionally, the various embodiments set forth herein are described in terms of exemplary block diagrams, flow charts and other illustrations. As will become apparent to one of ordinary skill in the art after reading this document, the illustrated embodiments and their various alternatives can be implemented without confinement to the illustrated examples. For example, block diagrams and their accompanying description should not be construed as mandating a particular architecture or configuration.

What is claimed is:

1. A self-contained portable unit for steam generation and injection for operation in oil wells, comprising:

an injector of coiled jacketed capillary tubing with a closed circuit;

self-contained equipment for injection and dewaxing of heated fluids, comprising:

a hose set comprising two lines of fluid injection, the lines being connected to the injector for making up a closed circuit;

wherein the wellhead comprises three modules crowned with a lid, two of which are a first hanger module and a second hanger module and at least one is an injector, one of said first hanger and second hanger modules having a set of double clamps that support capillary tubing;

wherein the injector overlaps the hanger modules and is fixed, the injector connected to the portable unit for steam generation via one line from the hose set, and overlapping the injection-type module, an upper hanger module is fixed, which has a capillary of smaller cross section and recovers steam from a well, and leading the fluid to the injector where it is treated thermally, and from the end of the capillary of the upper hanger module, it is inserted in the tubing, making the closed circuit.

2. A method for steam generation and injection by means of injector with closed circuit and procedure for operation in oil wells, comprising:

a coiled jacketed capillary tubing;

placing the self-contained portable unit for steam generation of claim 1 and supporting said unit next to a well;

turning a power plant on;

transferring raw water from the reservoir tank to a softener plant;

filling a treated water tank for feeding a boiler;

laying tubing and hoses for the transport and steam injection to the well to be worked on; securing the tubing and hoses for steam transport to the well at high pressure;

laying return hoses from well to reservoir tank;

turning on the steam jenny and continuing the water feeding valves from low pressure circuits to exchanger;

turning on the centrifugal pump for filling and pressurizing the high pressure system and the high pressure system is filled and pressurized (A.P. pump and exchanger);

wherein the recirculation of water feeding to the steam exchanger starts and the exchanger is loaded with steam.

3. The method or steam generation and injection by means of injector with closed circuit and procedure for operation in oil wells, of claim 2, wherein , the steam generation and injection unit is ready to feed the lines to the well and the method further comprising:

a coiled jacketed capillary tubing;

the lower wellhead hanger is mounted on the upper valve of a blowout tree;

the injector is mounted on the lower capillary tubing and the capillary tubing is inserted inside a riser;

a steam line between generating unit and capillaries is filled;

a steam blow-off valve to well steam conduction lines is opened;

the steam line between generating unit and capillaries is filled; the capillary is filled with steam at minimum pressure securing the capillary tubing end for washing and blow-off of the injected fluid;

the fluid injection to capillary tubing is fully cut;

the assembly in the end of the capillary tubing of the set of bottom-hole tool is performed;

fluid is poured at minimum pressure to perform a system hermetism test;

a working test of the system is performed by flushing fluid through the tool;

secondary are checked for leaks;

the riser is mounted with the bottom-hole tool on the lower wellhead hanger and the operating procedure to start lowering of the capillary is secured;

the master valve is opened and checked for potential leaks and the capillary tubing trip begins;

the system and steam injection are pressurized;

the spray injecting is performed simultaneously with the down trip of the capillary; the capillary tubing is located in the preset depth threshold and the dart is introduced to block the fluid, and it is displaced to block the capillary tubing;

a capillary tubing sealing pressure test is performed;

the steam injection cut is performed, the capillary line and injector system line are depressurized;

steam generation is stopped and the whole system is depressurized;

the riser located on the lower wellhead hanger is disassembled and the capillary tubing is cut;

the steam injection T body is mounted;

a smaller wellhead hanger is mounted;

the riser is mounted on the smaller wellhead hanger;

diggers and approximation of hydraulic injector wellhead are performed to start the down trip of a smaller capillary tubing;

the down trip of the smaller capillary tubing by smaller riser located over the body of the smaller wellhead hanger begins;

the smaller capillary tubing is introduced through the annular space of the capillary tubing;

the smaller capillary tubing in the preset depth threshold is located;

the riser on the smaller wellhead hanger is disassembled;

the smaller capillary tubing is cut;

the smaller wellhead hanger lid is mounted;

steam is generated in the jenny;

the mounting operations are performed for the link assembly and the fluid flow lockout valve in the upper portion of the smaller wellhead hanger;

the injection hose is connected to the T injection body and the fluid flow hose is connected on the return fluid flow lockout valve located on the smaller wellhead hanger;

pressure is injected and the system is pressurized on the surface;

pressures are equalized in the system and the well;

the steam intake to the wellhead hanger is opened;

fluid flows through the smaller capillary and return hose, heat energy recirculation takes place and the well's own fluid is stimulated, mobilizing the oil towards the surface by its own energy.

4. A self-contained portable unit for steam generation and injection for operation in oil wells, comprising:

an injector of coiled jacketed capillary tubing with a closed circuit;

a portable equipment for injection and dewaxing of heated fluids mounted on a hauler, comprising:

a first heat exchanger;

a water tank;

a second heat exchange;

a fluid softener;

a centrifugal pump;

a lubricant tank;

a power engine;

an electrical power generator;

a control cabin;

a steam boiler;

a reservoir tank;

a fuel tank;

a hose reel; and a hose set comprising two lines of fluid injection, the lines being connected to the injector for making up a closed circuit;

wherein the injector comprises three modules crowned with a lid, two of which are a first hanger module and a second hanger module and at least one is an injector, said hanger module having-a set of double clamps that support capillary tubing of greater section;

wherein the injector overlaps the hanger modules and is fixed for steam generation via a hose, and overlapping the injection-type module, an upper hanger module is fixed, which has a smaller capillary and recovers steam from a well, leading the fluid to the injector where it is treated thermally, and from the end of the capillary of the upper hanger module, it is inserted in the tubing, making the closed circuit.

5. The self-contained portable unit of claim 4:

wherein the portable unit is laid on a hauler built with a metallic section on a running gear to which a heat exchanger is fixed transversally on its front end, which is linked by tubing to a juxtaposed water tank and, transversally to the hauler;

wherein said water tank feeds water to the heat exchanger and the fluid softener;

wherein a centrifugal pump is juxtaposed to the water tank;

wherein a lubricant tank is juxtaposed to said water tank and transverse to a chassis, and the lubricant tank feeds lubricant through a tubing section to the power engine and the electric power generator, which are juxtaposed to each other and longitudinally with respect to the chassis;

wherein the control cabin and the fluid softener are connected through a tubing section to the steam boiler and are connected by a tubing section through which water is fed from the reservoir tank; and wherein the fuel tank is placed transversely and in back of the chassis to feed liquefied propane gas to a boiler;

wherein a reel holds a pair of hoses for two heated fluid conduction lines, comprising an injection line that leads steam to an the injector of a head, and a recovery line that leads steam or heated fluid from the upper hanger module which makes up said injector.

6. The self-contained portable unit for steam generation and injection by means of injector wellhead hanger of coiled jacketed capillary tubing with a closed circuit for operation in oil wells, of claim 4, wherein the two hanger modules provides the circuit for heated liquid circulation through strings entering, through first capillary tubing and recovering through second capillary tubing smaller than the first tubing;

wherein said hanging head is configured to overlap and support the well's head that the first hanger module is fixed to by means of a coupling flange to the upper well head flange;

wherein the first hanger module hosts a set of double clamps that supports the capillary with greater section;

wherein overlapping the two hanger modules is the injection module that is fixed by the respective coupling flanges, which are configured to allow access to the heated fluids line that is connected to said equipment;

wherein overlapping the injection module is the second hanger module that is fixed with the respective coupling flanges that are configured to fit the capillary with smaller diameter, which is fixed and hanged with a double clamp and jacketed by that capillary with greater section;

wherein at the top of the wellhead is a lid with a steam blowout duct;

wherein said first and second hangers have identical morphologies, in contrast to a rubber jacket that is placed in said upper hanger and the first and second hangers both comprise:

upper and lower threaded parts configured as external casing;

wherein the upper and lower threaded parts are configured to fit with each to form a seal and a cylindrical structure in vertical position with upper and lower connections in the shape of flanges; the upper and lower bodies, which have formed flanges, have a cylindrical configuration and in their corresponding ends there is an annular cantilever that offers a two flanges for coupling;

wherein the upper threaded portion comprises a cylindrical cavity with five portions having different diameters;

wherein a first of the five portions is located in an end and provides a circular mouth, followed by a second portion with a reduced diameter , followed by a third portion with the same diameter as the first portion, followed by a fourth portion with the same length as said first portion, and followed by the fifth portion that is configured in the end opposed to flange, finishing with a beveled border, which is connected to the cavity of the lower flange body;

wherein the upper threaded portion is configured to lock by a ninety-degree stop followed by a threaded wall, and the ninety-degree stop offers an annular surface that makes contact with the lower threaded portion and a dap around the wall, hosting a joint, which is followed by a second ninety-degree rounded border, followed by a second ninety-degree stop that finishes in a beveled edged opening that is configured to connect with a cylindrical cavity of the body of the lower threaded portion;

wherein the cavity having five more portions and each portion having different diameters wherein the sixth portion of the lower threaded portion's cavity configures as an opening with an upper perpendicular border configured to connect with the annular surface, followed by a beveled border configured such that when it is locked against the first ninety-degree border, followed by a second annular border where the upper threaded portion rests, followed by the seventh portion with a slightly smaller diameter, followed by an eighth portion that is longer with a slightly smaller diameter, followed by a joint border at ninety degrees, followed by a ninth portion with a slightly of greater diameter finishing in a right-angle edge that terminate in a tenth portion configured with an opening;

the opening of the tenth portion is configured to connect a cavity of the wellhead with a master valve which is connected to the blowout duct;

wherein first and second hanger modules respectively hold in their cavity a double clamp wherein each double clamp holds the capillaries that hang within tubing, referred to previously as capillary tubing. The first module holds the capillary with greater section and the second module is jacketed by this greater capillary and holds the smaller capillary;

wherein clamps are driven by means of hydraulic fluid that confers the packing force applied between both capillaries and the corresponding first hanger and such that the pressure can be regulated, monitored and modified at any time;

wherein the lower threaded body of each respective hanger modules have two lateral holes that connect to a pressure pump and a first hole receives hydraulic fluid with pressure and is configured to lead the fluid to the clamp that fits the capillary with a gear and is packed by compression of elastomers whereas the second hole, if open, spills the hydraulic fluid deactivating the clamps and the packing and releasing the capillary;

the clamps comprise:

three dentate clamps which are radially placed in a clamp holding a tubular jacket such that inner faces of cylindrical concave configuration equipped with a cross-sectional succession of teeth forming friction that moves towards the center of the module by displacement and holds the capillary adjusting to its diameter and fitting the tubing;

wherein any clamp has an interior groove or central valley that creates a double grasp clap by dividing each clamp into an upper and lower portion wherein the upper portion prevents the tubing from slipping upwards and the lower portion prevents the tubing from slipping downwards;

wherein each clamp has a clamp spring located in the central valley which is configured to keep the clamp expanded with their an external face close to the internal wall of the respective hanger module;

the clamps are configured to be open and closed by effect of the movement of cones which closes through compressing the spring;

wherein cones include a tubular cylindrical lower clamp cone and a tubular cylindrical upper clamp cone wherein each cone contains a truncated cone shaped internal portion with dimensions configured to exactly match the dimensions of the external face also of truncated cone shaped portion of each respective clamp such that when the clamp is driving by hydraulic pressure, this upper clamp cone moves in downwards coming near to lower clamp cone such that the three dentate clamps are gradually incorporated into this truncated cone shaped cavity moving towards the center of the module reducing the inner diameter and clamping the tubing;

wherein the double clamps have two jacket buffers an upper and a lower one that are solidary to the clamp carrying jacket and fix the cones to the jacket, keeping the set together so that they prevent the displacement of the cones when being distanced, maintaining all the pieces together;

the injection module is comprising:

a position configured to interpose the first and second hangers;

a lateral access duct by which a heating fluid is injected from the boiler;

a body of a tubular configuration in whose corresponding opposite ends they have an annular portion, with respect to a cylindrical wall configuring an upper yoke and a lower yoke, that connects to the lower yoke of the second hanger and one lower yoke that connects to the upper yoke of the first hanger;

an injection configured to inject the heating fluid between the capillaries;

an interior equipped with a heavy-duty sacrificial jacket that supports the change of direction of heating fluid and the possible erosion that this can cause to the capillary and allows for the circulation of heating fluids at high temperatures and pressures;

at the top of the wellhead and the fixed overlapping the second hanger module is a closing lid, which is coupled by a yoke with screws, that has a return hole that leads the steam or heating fluid to a hose connected to the portable unit allowing recovery of said fluid that is coming up from the well, such that a closed circuit is formed and the fluid does not come in contact with the well fluids and pressures;

wherein double clamps are configured to regulate the packing force even after the production process is started and the packing set is comprised of:

a rubber holding jacket configured to hold three rubber screws, two space rings built with a flexible high-temperature compound that is easily compressed and expanded with inner diameters compatible with the internal passing of the hanger where the flexible tubing passes and external diameters of these rings coinciding with the inner diameter of the yoke body, where they overlap and separated from each other by said rings that contain them at the time of compression, and between these rings are an upper retaining ring and a lower bumper;

an upper retaining ring over the rubber packing which serves as support and anti-extrusion barrier of the rubber at the time of compression;

a lower bumper underneath the rubber packing that supports and backs up the rubbers in compression state; and the ring is solidary to the lower body and lacks movement;

wherein the packing set seals and closes off the annular space between the outer diameter of the flexible tubing and the inner diameter of the hanger body, generating a barrier in the annular space of the well where the packing set activates when receiving an axial load with force applied downwards on the upper retaining ring which transmits to the pieces arranged underneath, wherein the axial load generates a compression on rubbers and they react expanding their volume concentrically towards the blowout zone, the center, until making contact and pressure against the flexible tubing located inside of the hanger, obtaining packing on the capillary;

wherein the axial load results from the applied hydraulic pressure through the lower hole that is in the lower body, simultaneously driving the clamps and the rubber set.

7. The self-contained portable unit for steam generation and injection by means of injector with closed circuit and procedure for operation in oil wells, of claim 4, further comprising a set of bottom-hole tools including:

a coiled jacketed capillary tubing;

a capillary connector;

a displacement dart;

a dart socket;

a foot valve; and an injections point;

wherein the capillary connector includes a cylindrical jacket device or segment carrier that is fitted by a dented internal superficial portion or catching segment that is fixed to the end of the tubing, providing a lock to assemble to the end of the flexible tubing with another device or bottom-hole tool;

wherein the dentated segment adheres to the external wall of the capillary connector by pressure exerted by a fitting thread;

wherein a dart locking section assembly, comprises:

a piece with socket seat made up of an elastomeric seal;

a socket ring and a bumper -that is located in the end of dart socket, fitted to said displacement dart, for being sent from surface to clean the tubing before the injection of steam and blinding the lower end of the flexible tubing is introduced into the well;

a metal nose to which a fluttered elastomer tail is fitted so that, when sent from the upper end of the tubing on surface and by means of pumping fluid or steam, it is impelled by the interior of the tubing to the lower end, where it is fit in the socket seat to seal and close off the end of the tubing;

wherein after said dart locking section, the foot valve is fixed, which prevents the entrance of well fluids to the interior of the flexible tubing, forming a one way valve, that allows the passage of fluid downwards and prevents the passage of fluid upwards;

two pieces make up a cavity that houses a sphere that, when receiving downward pressure, is opened and, when receiving upwards pressure, it is closed;

an injection point in the lower end of the bottom-hole tools set, is connected to foot valve and includes a cylindrical body with the lower end forming a conical end of acute angle that facilitates the insertion of the bottom device in the well;

a series of reduced lateral holes which connect to the camera and blow out the upward fluid producing a jet effect when steam comes out of the flexible tubing, for releasing steam, such that when coming out of the lateral holes, the steam acquires great speed, facilitating the removal of high viscosity petroleum layers during operation.

* * * * *